US010700429B2

(12) United States Patent
Mehdipour et al.

(10) Patent No.: US 10,700,429 B2
(45) Date of Patent: Jun. 30, 2020

(54) IMPEDANCE MATCHING FOR AN APERTURE ANTENNA

(71) Applicant: Kymeta Corporation, Redmond, WA (US)

(72) Inventors: Aidin Mehdipour, Redmond, WA (US); Mohsen Sazegar, Kirkland, WA (US); Anthony Guenterberg, Puyallup, WA (US); Robert Thomas Hower, Redmond, WA (US); Chris Eylander, Redmond, WA (US); Ryan Stevenson, Woodinville, WA (US); Nathan Kundtz, Kirkland, WA (US)

(73) Assignee: KYMETA CORPORATION, Redmond, WA (US)

( * ) Notice: Subject to any disclaimer, the term of this patent is extended or adjusted under 35 U.S.C. 154(b) by 0 days.

(21) Appl. No.: 15/701,328

(22) Filed: Sep. 11, 2017

(65) Prior Publication Data

US 2018/0076521 A1 Mar. 15, 2018

Related U.S. Application Data

(60) Provisional application No. 62/394,582, filed on Sep. 14, 2016, provisional application No. 62/394,587,
(Continued)

(51) Int. Cl.
*H01Q 5/48* (2015.01)
*H01Q 5/335* (2015.01)
(Continued)

(52) U.S. Cl.
CPC ..... *H01Q 5/335* (2015.01); *H01Q 3/26* (2013.01); *H01Q 5/48* (2015.01); *H01Q 9/0442* (2013.01);
(Continued)

(58) Field of Classification Search
CPC ..... H01Q 13/103; H01Q 15/0026; H01Q 15/0066; H01Q 21/0031; H01Q 21/0056;
(Continued)

(56) References Cited

U.S. PATENT DOCUMENTS 3,995,277 A * 11/1976 Olyphant, Jr. ..... H01Q 13/206 343/846
4,063,248 A * 12/1977 Debski ..... H01Q 9/20 343/727
(Continued)

OTHER PUBLICATIONS

PCT Application No. PCT/US2017/051355, Notification of Transmittal of the International Search Report and the Written Opinion, dated Nov. 30, 2017, 16 pgs.
International Preliminary Report on Patentability received for PCT Patent Application No. PCT/US2017/051355, dated Mar. 28, 2019, 13 pages.

*Primary Examiner* — Tho G Phan
(74) *Attorney, Agent, or Firm* — Womble Bond Dickinson (US) LLP

(57) ABSTRACT

A method and apparatus for impedance matching for an antenna aperture are described. In one embodiment, the antenna comprises an antenna aperture having at least one array of antenna elements operable to radiate radio frequency (RF) energy and an integrated composite stack structure coupled to the antenna aperture. The integrated composite stack structure includes a wide angle impedance matching network to provide impedance matching between the antenna aperture and free space and also puts dipole loading on antenna elements.

33 Claims, 16 Drawing Sheets

Related U.S. Application Data filed on Sep. 14, 2016, provisional application No. 62/413,909, filed on Oct. 27, 2016.

(51) Int. Cl.

| | |
|---|---|
| ***H01Q 21/00*** | (2006.01) |
| ***H01Q 15/00*** | (2006.01) |
| ***H01Q 3/26*** | (2006.01) |
| ***H01Q 9/04*** | (2006.01) |
| ***H01Q 13/10*** | (2006.01) |
| ***H01Q 21/06*** | (2006.01) |

(52) U.S. Cl.

CPC ..... *H01Q 9/0457* (2013.01); *H01Q 13/103* (2013.01); *H01Q 15/0026* (2013.01); *H01Q 15/0066* (2013.01); *H01Q 21/0031* (2013.01); *H01Q 21/0056* (2013.01); *H01Q 21/065* (2013.01)

(58) Field of Classification Search

CPC ..... H01Q 21/065; H01Q 3/26; H01Q 5/335; H01Q 5/48; H01Q 9/0442; H01Q 9/0457

See application file for complete search history.

(56) References Cited

U.S. PATENT DOCUMENTS

| | | | | |
|---|---|---|---|---|
| 4,870,426 | A * | 9/1989 | Lamberty | H01Q 21/061 343/727 |
| 5,189,433 | A * | 2/1993 | Stern | H01Q 3/24 343/770 |
| 5,512,906 | A * | 4/1996 | Speciale | H01Q 13/18 342/375 |
| 5,872,545 | A * | 2/1999 | Rammos | H01Q 21/0075 343/700 MS |
| 6,087,989 | A * | 7/2000 | Song | H01Q 9/285 343/700 MS |
| 7,423,595 | B2 * | 9/2008 | Saily | H01Q 9/0407 343/700 MS |
| 2003/0011522 | A1 | 1/2003 | McKinzie, III et al. | |
| 2010/0073232 | A1 | 3/2010 | Sajuyigbe et al. | |
| 2012/0200474 | A1 | 8/2012 | Sabielny | |
| 2015/0123864 | A1 | 5/2015 | Boryssenko | |
| 2015/0236412 | A1 | 8/2015 | Bily et al. | |

* cited by examiner

Radial Line Aperture Antenna
120

Iris L2

Iris L1

Patch and Iris L1

Top View

IMPEDANCE MATCHING FOR AN APERTURE ANTENNA

PRIORITY

The present patent application claims priority to and incorporates by reference the corresponding provisional patent application Ser. No. 62/394,582, titled, "WAIM RADOME," filed on Sep. 14, 2016, provisional patent application Ser. No. 62/394,587, titled, "DIPOLE SUPERSTRATE," filed on Sep. 14, 2016, and provisional patent application Ser. No. 62/413,909, titled, LIQUID CRYSTAL (LC)-BASED TUNABLE IMPEDANCE MATCH LAYER," filed on Oct. 27, 2016.

FIELD OF THE INVENTION

Embodiments of the present invention relate to the field of satellite communications; more particularly, embodiments of the present invention relate to wide angle impedance matching structures used in a satellite antenna to increase gain.

BACKGROUND OF THE INVENTION

Antenna gain is one of the most important parameters for satellite communications systems since it determines the network coverage and speed. More specifically, more gain means better coverage and higher speed which is critical in the competitive satellite market. The antenna gain over the receive (Rx) band can be critical because, on the satellite side, the receive power at the antenna is very low. This becomes even more critical at scan angles for flat-panel electronically scanned antennas due to the increased attenuation and lower antenna gain at these angles compared to broadside case, making a higher gain value a vital parameter to close the link between the antenna and the satellite. Over the Tx band, the gain is also important since lower gain means more power needs to be supplied to the antenna to achieve the desired signal strength, which means more cost, higher temperature, higher thermal noise, etc.

One type of antenna used in satellite communications is a radial aperture slot array antenna. Recently, there has been a limited number of improvements to the performance of such radial aperture slot array antennas. Dipole loading has been mentioned for use with radial aperture slot array antennas but it shifts the frequency response of the antenna and the improvement is marginal. A slot-dipole concept has also been applied to radial aperture slot array antennas to improve the directivity of the antenna, including to improve the overall return loss performance of the antenna, particularly, antennas operating at broadside.

SUMMARY OF THE INVENTION

A method and apparatus for impedance matching for an antenna aperture are described. In one embodiment, the antenna comprises an antenna aperture having at least one array of antenna elements operable to radiate radio frequency (RF) energy and an integrated composite stack structure coupled to the antenna aperture. The integrated composite stack structure includes a wide angle impedance matching network to provide impedance matching between the antenna aperture and free space and also puts dipole loading on antenna elements.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1A:
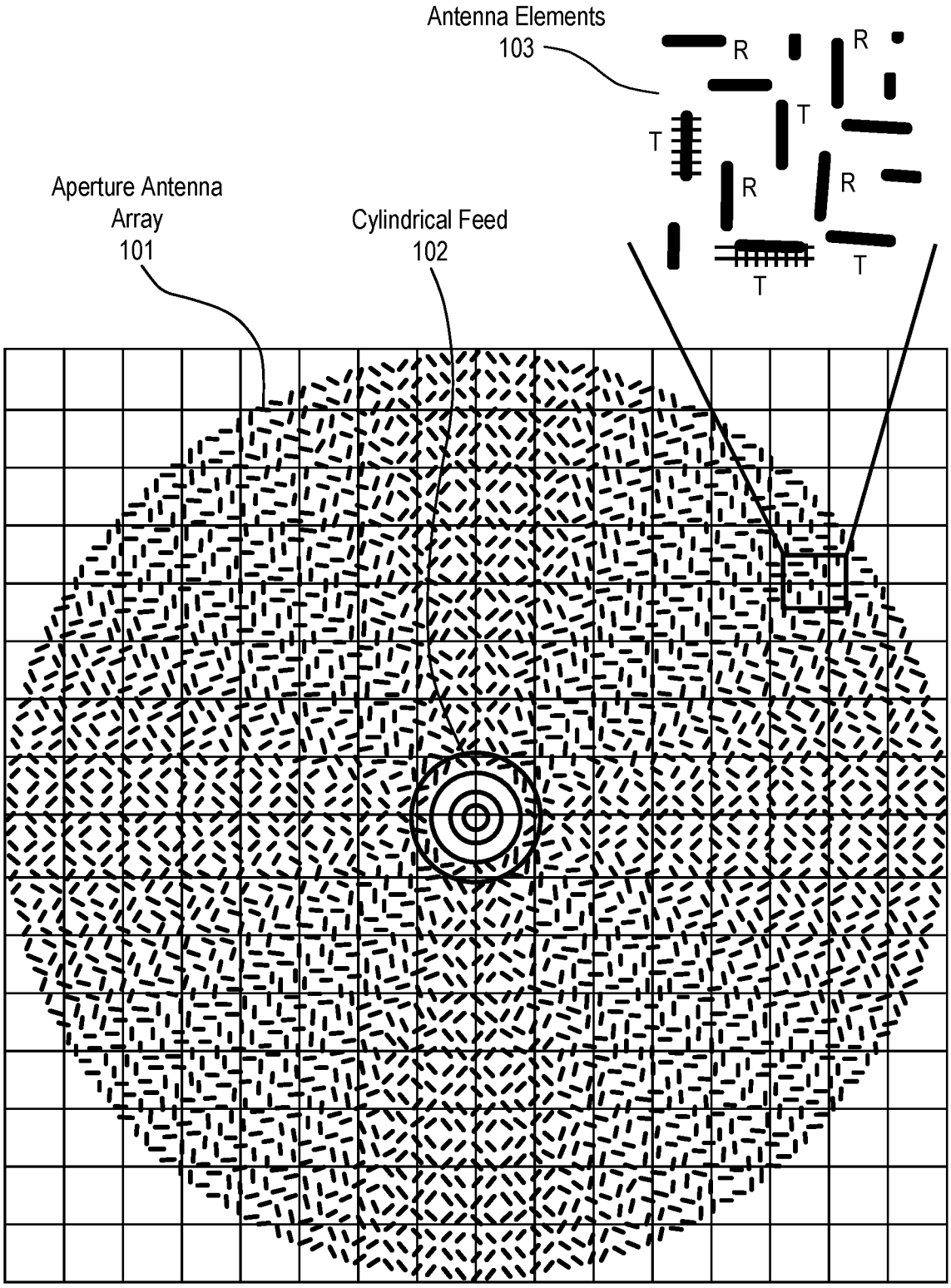
FIG. 1A illustrates one embodiment of a holographic radial aperture antenna with receive (Rx) and transmit (Tx) slot radiators.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

An antenna comprising an antenna aperture and an impedance matching network coupled to and positioned over the antenna aperture for impedance matching between the antenna aperture and free space are disclosed. The impedance matching network is part of an integrated composite stack structure that is in mechanical contact with the radiating surface of the antenna aperture. In one embodiment, the integrated composite stack structure improves the radiation efficiency of the antenna aperture while providing wide angle impedance matching at the same time. The integrated composite stack structure also improves the antenna gain at the broadside and at multiple scan angles. In one embodiment, the integrated composite stack structure includes dipole loading that operates to distribute radio frequency (RF) currents, which effectively increases the size of the radiating elements, thereby increasing their efficiency. In one embodiment, the composite stack structure includes one or more homogenous metasurfaces and the radome of the antenna.

In one embodiment, the integrated composite stack structure is a wideband design in that it provides the increase in efficiency and the disclosed matching for an antenna aperture that includes both receive and transmit radiating antenna elements on the same physical structure.

More specifically, in one embodiment, the impedance matching network includes elements that are sized and positioned with respect to the antenna elements (e.g., irises) to provide a desired impedance matching. In one embodiment, the elements comprise one or more dipole elements that are aligned with antenna elements in the antenna aperture, where the antenna elements are operable to radiate radio frequency (RF) energy. In one embodiment, the impedance matching network is a wide-angle impedance matching network in that it provides impedance matching for all scan angles included in a range from broadside to extreme scan roll-off angles. For purposes herein, any angle other than broadside (0°) is considered a scan roll-off angle. At scan roll-off angle, the scan loss of the antenna become larger than the pure cosine of the angle such that for larger scan roll-off angles the scan loss becomes even much more significant. In one embodiment, the extreme scan roll-off angles are typically between 50-75° but may be outside that range toward end-fire angles (90°). In one embodiment, the scan roll-off angle is 60°, while in another embodiment, the scan roll-off angle is 75°.

There are a number of different wide-angle impedance matching networks disclosed herein. In one embodiment, the wide-angle impedance matching network comprises a metasurface stackup. In another embodiment, the wide-angle impedance matching network comprises a wide angle impedance match (WAIM) surface layer. Each of these is described in greater detail below.

A Metasurface Stackup

As discussed above, a metasurface stackup may be used as a wide-angle impedance matching network to provide impedance matching for an antenna aperture having antenna elements. In one embodiment, the metasurface stack up comprises a number of metasurface layers, where a metasurface layer comprises a layer with a specific metallic pattern to provide desirable electromagnetic response. The metallic pattern may be a printed pattern. In one embodiment, the metasurface stackup comprises several metallic layer and dielectric layer pairs located at a predefined distance above the antenna aperture. In one embodiment, the metasurface stackup improves the gain of the antenna aperture.

In one embodiment, the metasurface stackup is positioned above a liquid crystal (LC)-based holographic radial aperture antenna to improve its gain. Such a metasurface stackup also broadens the dynamic bandwidth at all scan angles (from broadside to extreme angles such as the scan roll-off angles) for both horizontal and vertical polarizations over both receive (Rx) and transmit (Tx) frequencies. The Rx and Tx frequencies may be part of a band, such as, for example, but not limited to, the Ku-band, Ka-band, C-band, X-band, V-band, W-band, etc.

In one embodiment, the metasurface stackup provides a significant performance improvement at all scan angles for a radial aperture. In one embodiment, the antenna aperture comprises antenna elements that include thousands of separate Rx and Tx slot radiators, as antenna elements, that are interleaved with each other. Such antenna elements comprise surface scattering antenna elements and are described in greater detail below. The metasurface stackup acts as a powerful impedance matching network between the antenna aperture and free space, maximizing the radiated power by the antenna aperture into the free space over both Rx and Tx frequency bands simultaneously. Furthermore, the stackup provides very good impedance matching for both Rx and Tx radiators over all scan angles.

In one embodiment, the stackup comprises metasurface layers separated by dielectric layers (e.g., foam slabs, any type of low loss, dielectric material (e.g., typically less than 0.02 tangent loss), such as, for example, but not limited to closed cell foams, open cell foams, honeycomb, etc.). In one embodiment, the metasurface layers comprise rotated dipole elements distributed periodically on a surface of or throughout a substrate. In one embodiment, the substrate comprises a circuit board surface. Although the dipoles on each metasurface are in a rotated type of distribution, the impedance surface concept may be effectively applied in design process due to the subwavelength nature of the structure.

In one embodiment, the use of a metasurface stackup improves the antenna gain significantly at all scan angles over both Rx and Tx bands. In one embodiment, by characterizing the impedance surface values at each layer and thickness of substrate layers (e.g., PCBs, foams, other materials onto which metal patterns may be glued or printed, etc.) and dielectric layers (e.g., foam layers), up to +3.8 dB of gain improvement can be achieved over all scan angles, for example, from broadside to 70°. In one embodiment of a Ku-ASM antenna designed for maritime applications, 0-60° are all scan angles. In one embodiment, using the metasurface stackup disclosed herein on top of the radial aperture improves gain over the Rx band by +2 dB at broadside angle and +3.8 dB at 60 degrees scan roll-off angle, while the gain is improved over Tx band by +1 dB at broadside angle and +3 dB at 60 degrees scan roll-off angle.

FIG. 1A illustrates the schematic of one embodiment of a cylindrically fed holographic radial aperture antenna. Referring to FIG. 1A, the antenna aperture has one or more arrays 101 of antenna elements 103 that are placed in concentric rings around an input feed 102 of the cylindrically fed antenna. In one embodiment, antenna elements 103 are radio frequency (RF) resonators that radiate RF energy. In one embodiment, antenna elements 103 comprise both Rx and Tx irises that are interleaved and distributed on the whole surface of the antenna aperture. Examples of such antenna elements are described in greater detail below. Note that the RF resonators described herein may be used in antennas that do not include a cylindrical feed.

In one embodiment, the antenna includes a coaxial feed that is used to provide a cylindrical wave feed via input feed 102. In one embodiment, the cylindrical wave feed architecture feeds the antenna from a central point with an excitation that spreads outward in a cylindrical manner from the feed point. That is, a cylindrically fed antenna creates an outward travelling concentric feed wave. Even so, the shape of the cylindrical feed antenna around the cylindrical feed can be circular, square or any shape. In another embodiment, a cylindrically fed antenna creates an inward travelling feed wave. In such a case, the feed wave most naturally comes from a circular structure.

In one embodiment, antenna elements 103 comprise irises and the aperture antenna of FIG. 1A is used to generate a main beam shaped by using excitation from a cylindrical feed wave for radiating irises through tunable liquid crystal (LC) material. In one embodiment, the antenna can be excited to radiate a horizontally or vertically polarized electric field at desired scan angles.

In one embodiment, the impedance matching network comprising a metasurface stacked structure having a number of metasurface layers separated from each other by at least one dielectric layer, where each of the metasurface layers comprises a plurality of dipole elements, and each dipole element is aligned with respect to one antenna element (e.g., iris) in antenna array 101. The number of metasurface layers comprises 1, 2, 3, 4, 5, etc. and is based on the impedance matching that is desired for the antenna aperture.

In one embodiment, each dipole element is rotated with respect to an axis of one antenna element. In one embodiment, the array of antenna elements comprises a plurality of receive slot radiators interleaved with a plurality of transmit slot radiators, and the plurality of dipole elements are above and aligned with the plurality of receive slot radiators. Note that in one embodiment, there is at least one dipole element for each Rx antenna elements (e.g., receive slot radiators). In alternative embodiments, not all of the Rx antenna elements (e.g., receive slot radiators) have dipole elements above them. In one embodiment, the transmit slot radiators do not have a dipole element above them. In one embodiment, each of the plurality of dipole elements is aligned with the polarization of its corresponding receive slot radiator. In one embodiment, each of the plurality of dipole elements is perpendicular with respect to its corresponding receive slot radiator (antenna element).

Figure 1B:
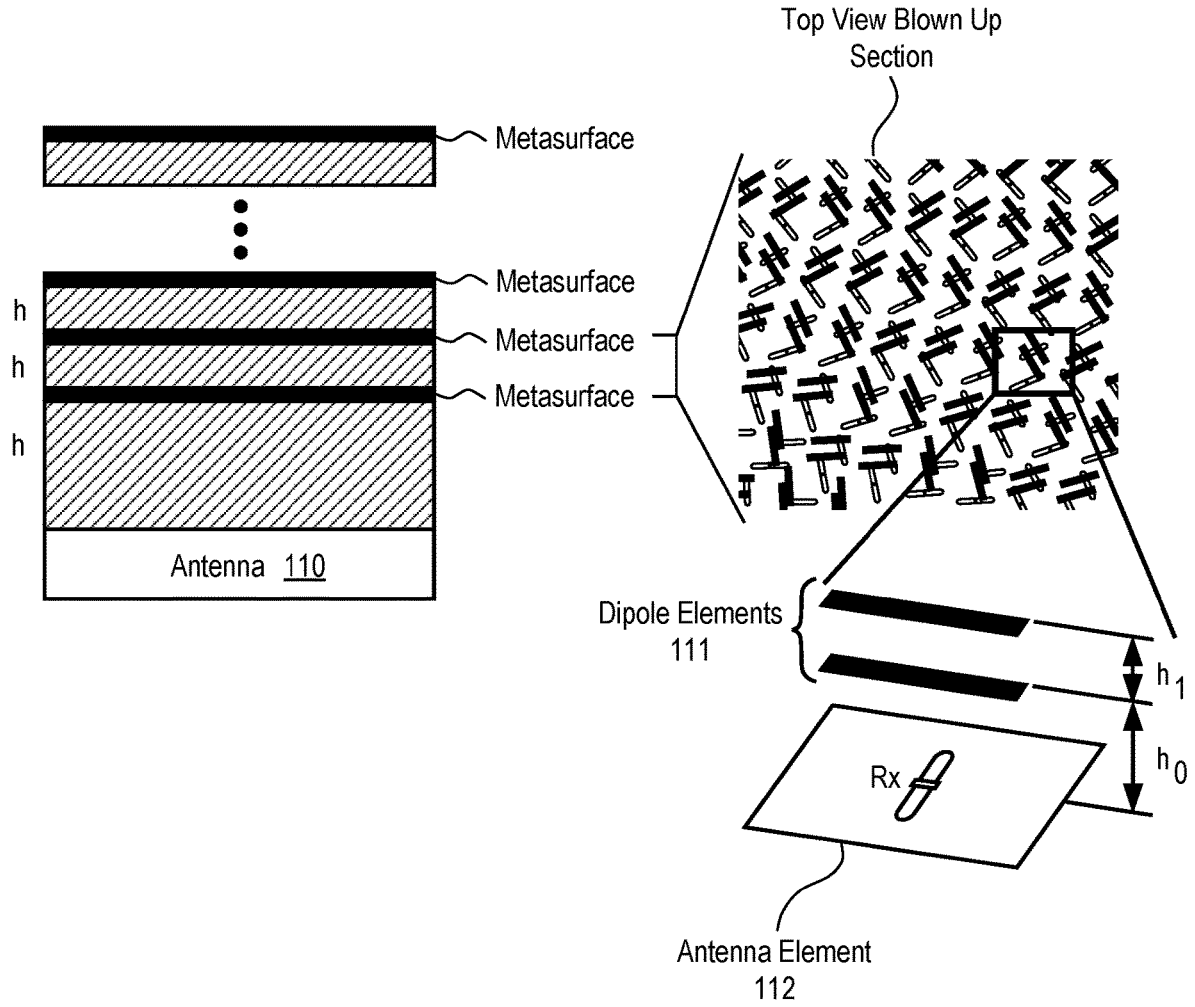
FIG. 1B illustrates one embodiment of a metasurface stackup located at top of the antenna (in subset an example of two layer metasurface is shown).

FIG. 1B illustrates one embodiment of stackup geometry to be placed at top of the antenna at the correct distance or height from antenna aperture 110. Referring to FIG. 1B, the stackup comprises N number of metasurfaces separated by dielectric layer (e.g., foam or other low loss low dielectric material). The stackup is placed on top of the antenna in a way that the dipole elements of metasurface are aligned with respect to the Rx irises of antenna elements with no dipole element on top of Tx irises of antenna elements.

As an example, in FIG. 1B, a subset of the first two metasurface layers (metasurfaces 1 and 2) including dipole elements are shown positioned over on Rx antenna elements. That is, the top view of a blown up section of the two metasurface layers with the underlying Rx antenna elements are shown. In one embodiment, the dipole elements are metallic strips printed or otherwise fabricated on a substrate and the size of the dipole elements are the same on each layer. However, the dipole elements may be different sizes on different layers or the same layer. The dipole elements are sized based on the desired impedance matching that is sought for the size of Rx antenna element (e.g., Rx iris). In one embodiment, the dipole element is a metal structure that 180 mil×30 mil. In one embodiment, the metal is copper. However, the metal may other types of highly conductive metal or alloy, such as, for example, but not limited to, Aluminum, silver, gold, etc.).

Two dipole elements 111 are shown separated by different distances from antenna element 112 using dielectric layers that have different or the same heights. In one embodiment, the height of the dielectric layers is a function of the frequency of operation of the Rx/Tx antenna elements. That is, heights of dielectric layers of the metasurface layers are selected based on a satellite band frequency at which receive slot radiators of the plurality of receive slot radiators operate and a satellite band frequency at which transmit slot radiators of the plurality of transmit slot radiators operate. In one embodiment, the height of the dielectric layers is such that the greater the frequency (and thus the smaller the wavelength), the smaller the size of the dielectric layers. In one embodiment, one of dipole elements 111 is at a height $h_0$ from antenna element 112, an Rx iris, while the other is at a height $h_0+h_1$ from antenna element 112. In one embodiment, $h_0$ is 40+/−5 mil and $h_1$ is 60+/−5 mil such that the second metasurface layer from the antenna aperture is 100+/−5 mil away.

Figure 1C:
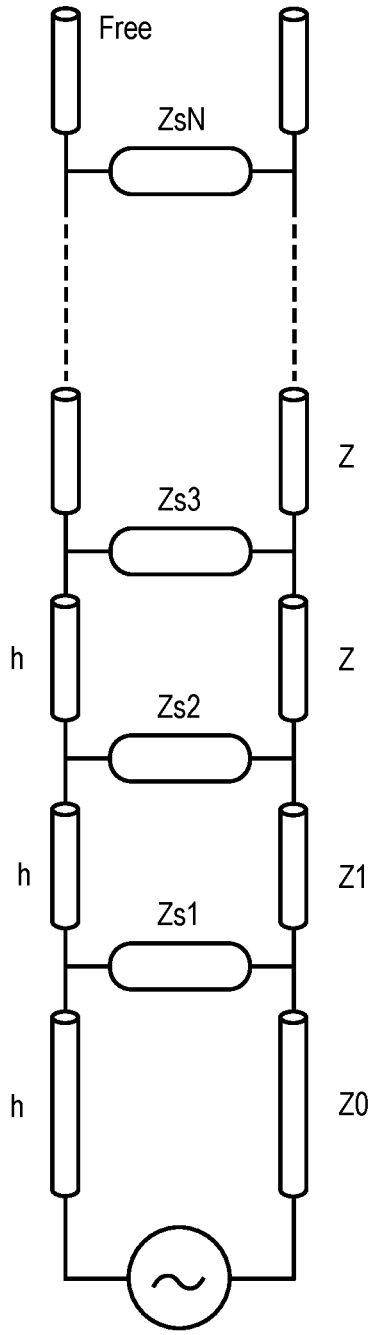
FIG. 1C illustrates a transmission line model of the stackup of FIG. 1B on top of the antenna for numerical/analytical code analysis.

Due to the subwavelength nature of the metasurface layers in the stackup, such as the stackup shown in FIG. 1B, it can be treated as equivalent surface impedance. FIG. 1C shows the equivalent transmission line models of the stackup on top of the antenna aperture indicating how it is used for impedance matching analysis. In one embodiment, the metasurfaces with dipole elements are modeled by equivalent surface impedance (Zs) in the stackup. Note that the number of layers, thicknesses, and material properties of the stackup are chosen to increase, and potentially maximize, the performance over both Rx and Tx bands at all scan angles and for both orthogonal linear polarizations (horizontal and vertical). As depicted in FIG. 1C, the stackup matches the antenna impedance to the free space impedance ($\eta$=377 ohm). Thus, the transmission coefficient between the antenna and free space increases, which means more power would be able to radiate to free space. Thus, the stackup increases the radiation efficiency of the antenna drastically.

The stackup is advantageous in that it is easy to manufacture. In one embodiment, the metasurface layers comprise a thin substrate (e.g., up to 5 mil) with the dipole elements printed onto the substrate. The substrate may comprise a number of different materials. In one embodiment, the substrate comprises a printed circuit board (PCB). Alternatively, the substrate may comprise a foam layer or any low loss dielectric material such as, for example, thermoplastic films (e.g. polyimide), thin sheets (e.g. Teflon, polyester, polyethylene, etc.). In one embodiment, the substrate has a dielectric constant k of 1-4 (e.g., 3.5), which is the dielectric constant of the dielectric layers (though this is not required). In one embodiment, the metasurface layers and the dielectric layers separating the metasurface layers and separating the stackup from the antenna aperture are bounded together. In one embodiment, the metasurface layers and the dielectric layers separating the metasurface layers and separating the stackup from the antenna aperture are bounded or glued together using an adhesive (e.g., a pressure sensitive adhesive (PSA), b-stage epoxy, dispensed adhesive like, for example, an epoxy or acrylic-based adhesive, or any adhesive material that is thin and low loss). In another embodiment, the low dielectric layer (e.g., a closed cell material foam) is fused to the metasurface layer by applying heat and pressure. In yet another embodiment, the conductive layer is fused directly to the low dielectric layer (e.g., foams) and etched directly, thus eliminating the substrate and adhesive.

In one embodiment, the layers of the metasurface stackup are aligned with each other using fiducials on the metasurfaces. Once aligned, the stackup is bound together and attached to a radome. Note that in one embodiment, the radome not only provides an environmental enclosure but also provides structural stability to the antenna. Thereafter, the radome with the stackup is aligned using fiducials with antenna elements of the antenna aperture and attached to the antenna aperture.

Figure 2A:
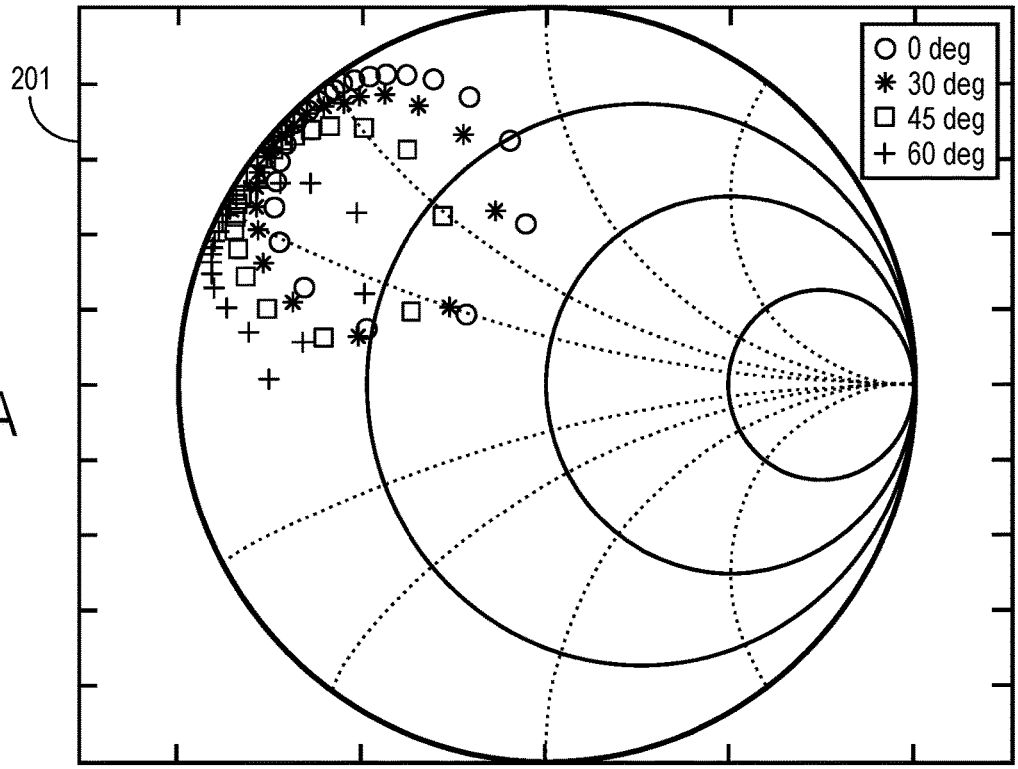
FIGS. 2A and 2B illustrate a reflection coefficient at different angles on a Smith chart for an antenna without a metasurface stackup and an antenna with a metasurface stackup disclosed herein, respectively.
Figure 2B:
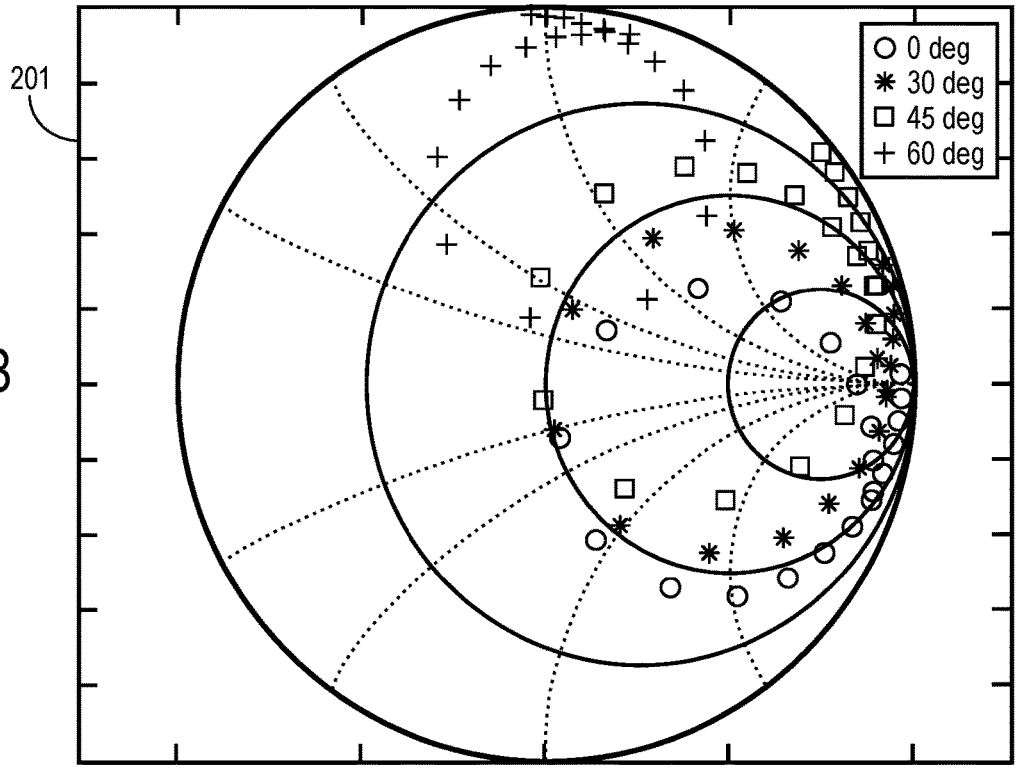

FIGS. 2A and 2B illustrate the reflection coefficient of the antenna over Rx band on a Smith chart generated for different scan angles, namely 0, 30, 45, and 60 degrees. FIG. 2A shows the results of the antenna itself without a stackup, which indicates quite poor impedance matching. When the metasurface stackup is included on top of the antenna, the curves get much closer to the center of the Smith chart, as shown in FIG. 2B, meaning that the impedance matching is significantly improved at all scan angles.

Figure 3A:
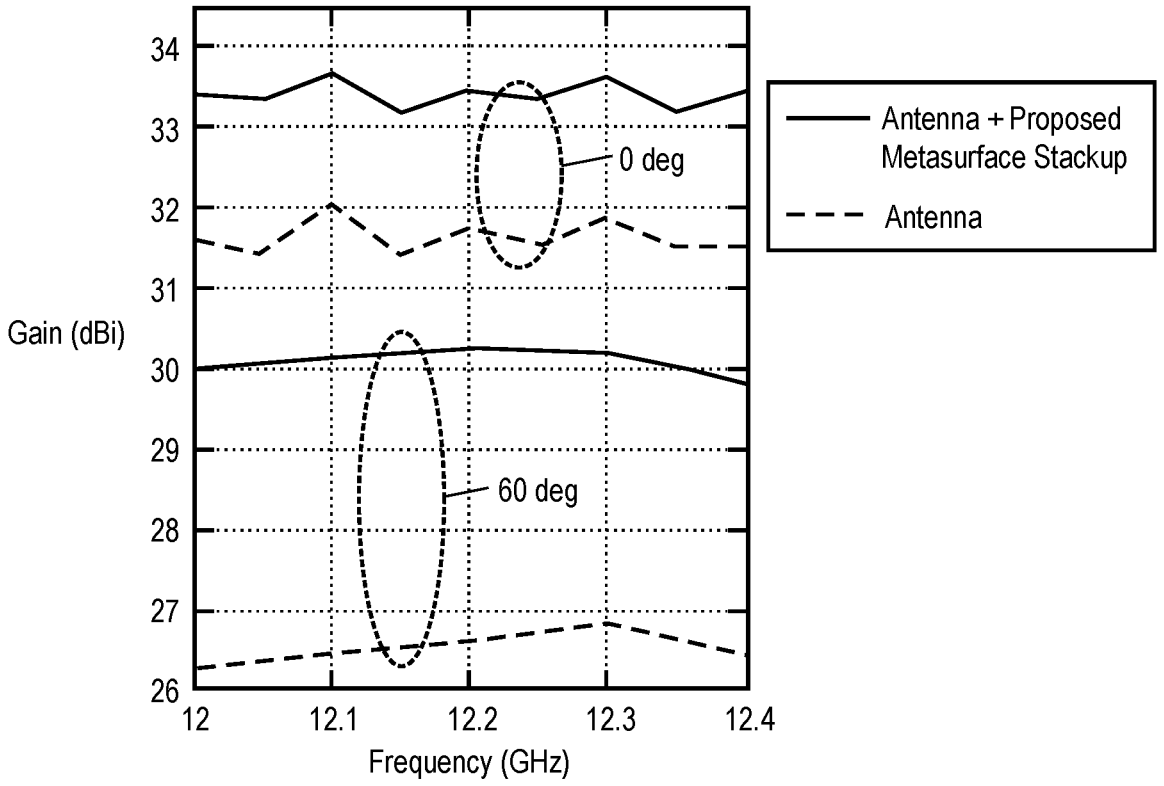
FIGS. 3A and 3B illustrate impact of an embodiment of a metasurface stackup on the gain of the Ku-band liquid crystal (LC)-based holographic radial aperture antenna at 0 and 60 degrees scan angles over receive and transmit frequency bands, respectively.
Figure 3B:
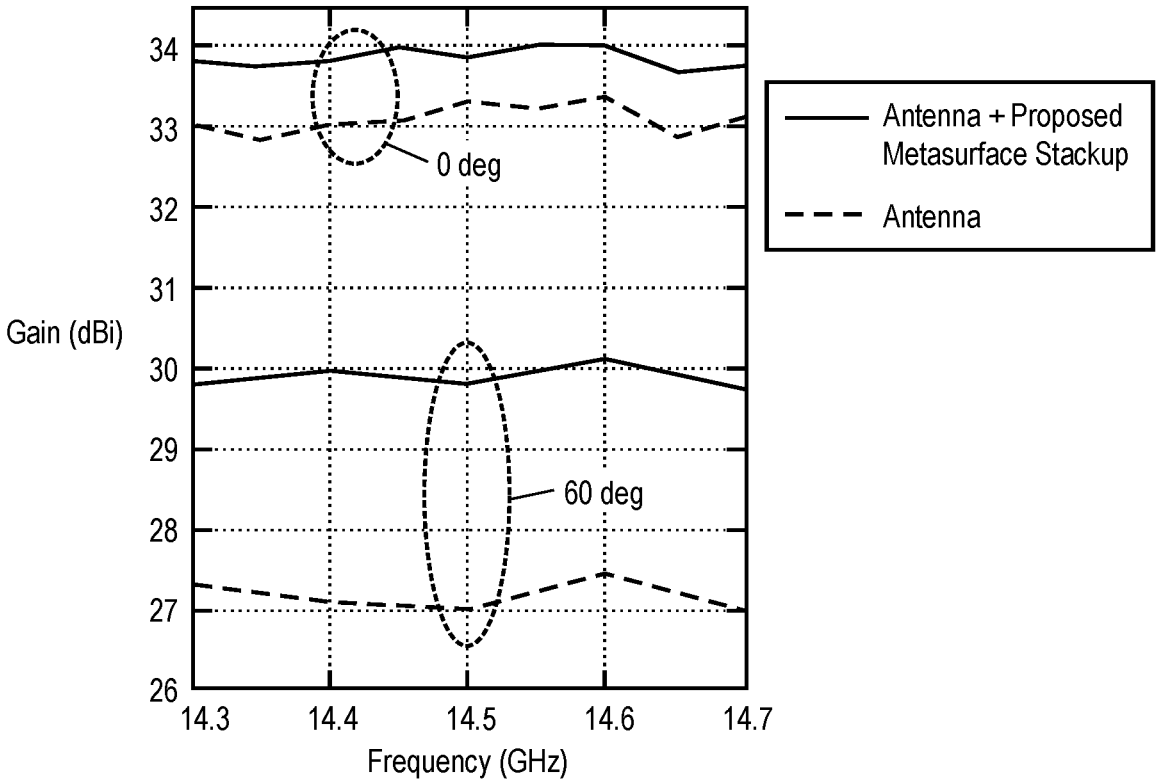

FIGS. 3A and 3B illustrate the measured gain of an antenna over both Rx and Tx frequency bands at two scan angles, namely broadside (0°) and extreme scan angle (60°). FIGS. 3A and 3B demonstrates that by using the stackup described herein on top of the antenna, the gain is improved considerably. At Rx, there is up to +2 dB and +3 dB gain improvement at broadside and 60° scan angles, respectively. At Tx, the gain is improved by +1 dB and +3 dB at broadside and 60° scan angles, respectively. Thus, the stackup improves the antenna performance significantly at all scan angles over both Rx and Tx frequency bands. This increases the network coverage, bandwidth, and speed drastically. Furthermore, the metasurface stackup increases the radiation efficiency of the antenna as well as improving the gain and reducing the noise temperature, thereby resulting in even higher gain-to-noise-temperature (G/T) for satellite antennas.

Note that the disclosed stackup can be applied to many types of electronically beam scanning antennas, such as, for example, but not limited to, phased arrays or leaky wave antenna, for gain improvement and impedance matching purposes. The stackup can be also used for frequency scanning radar antennas due to the wideband nature of the design.

Thus, a metasurface stackup has been disclosed that includes tunable impedance match layers to tune both magnetic and electric response of an aperture antenna (e.g., a cylindrically-fed holographic radial aperture antenna).

WAIM Radome

In another embodiment, the impedance matching network comprises a wide-angle impedance match (WAIM) surface layer above the antenna aperture (e.g., a cylindrically fed holographic radial aperture antenna) to improve the antenna gain at oblique scan angles for the horizontally polarized electric field (H-pol E-field) case. In other words, embodiments of the present invention include a combination of a WAIM layer and a cylindrically fed holographic radial aperture antenna. More specifically, the H-pol gain of radial aperture leaky-wave antenna degrades significantly when the beam points to oblique angles. Using the WAIM layer disclosed herein, gain is improved drastically.

Figure 4A:
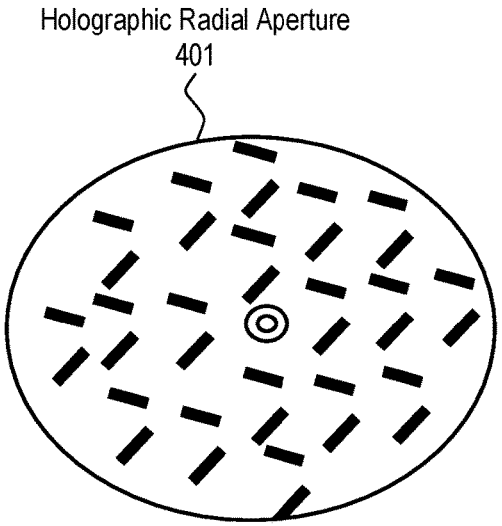
FIGS. 4A and 4B illustrate a schematic of one embodiment of a cylindrically fed holographic radial aperture antenna and a wide-angle impedance matching (WAIM) surface above the antenna, respectively.

FIG. 4A illustrates a schematic of the cylindrically fed holographic antenna such that the main beam is shaped by using proper excitation distribution for antenna elements having radiating irises. One example of such is shown in FIG. 1A. The antenna elements with irises are described in greater detail below. When irises are excited in such a way to radiate H-pol E-field at scan roll-off angles (e.g., 60°), the radiation performance deteriorates significantly.

Figure 4B:
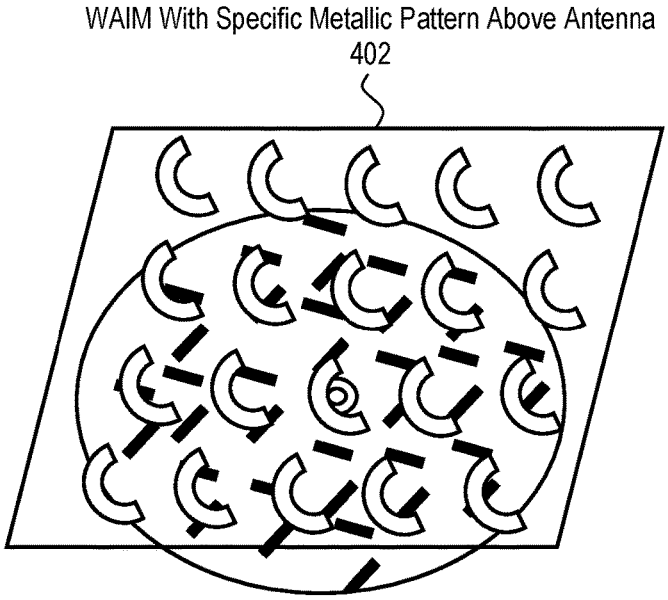

FIG. 4B illustrates one embodiment of a WAIM layer for impedance matching between an antenna aperture and free space. Referring to FIG. 4B, a very thin WAIM layer 402 has a metallic pattern and is placed above the antenna surface. In one embodiment, the pattern is periodic; however, this is not required and a non-periodic pattern may be used. In one embodiment, the WAIM layer is 2 mil thick substrate with a metallic pattern printed or fabricated thereon. The WAIM structure is designed to improve H-pol E-field beam performance at scan roll-off angles.

At roll-off scan angles, the mismatch between the radiating impedance of the cylindrically fed holographic antenna and free space impedance is noticeable for the H-pol. E-field case. As a result, antenna radiation characteristics degrade considerably at those angles. In one embodiment, the WAIM layer includes ring-shaped elements. Due to the ring-shape of the elements of WAIM layer, it reacts to the H pol. E-field since the main axis of rings is parallel to the magnetic field. As a result, the WAIM layer acts as an impedance matching circuit so that the antenna with the WAIM radiates more power efficiently at roll-off scan angles.

Figure 4C:
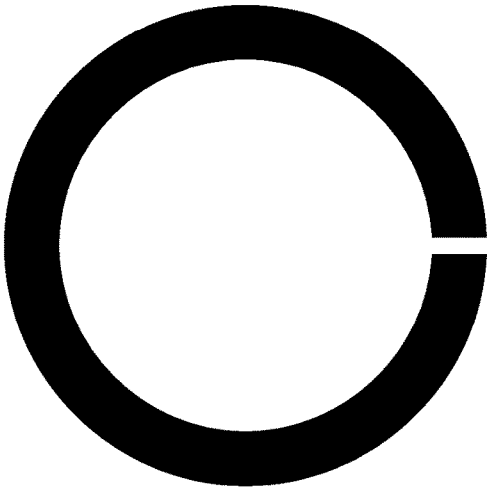
FIG. 4C illustrates an example of a split ring resonator.

Note that the shape of the elements in the metallic pattern of the WAIM layer are selected to obtain the impedance matching that is desired. In one embodiment, the elements have a ring-shaped pattern. In one embodiment, the ring-shaped elements are a split ring resonators (SRR). These unclosed rings have one gap in them so that they do not form a full circle. FIG. 4C illustrates an example of a split ring resonator. In one embodiment, the thickness, size and position of the ring-shaped elements are factors that are selected to obtain the necessary impedance for matching the antenna aperture to free space. That is, by choosing the thickness, size and position, the desired impedance matching with the best performance at roll-off and little impact on other angles and polarization performance may be obtained. Note that the ring-shaped elements need not be aligned with the resonating antenna elements of the antenna aperture as with the metasurface stackup. In one embodiment, the ring-shaped elements have a periodicity. In one embodiment, the periodicity of the ring-shaped elements is around 80 mil+/−10 mil.

The WAIM layer is separated from the antenna aperture via a dielectric layer (e.g., foam or any kind of low loss, low permittivity material, etc.). In one embodiment, the dielectric foam layer has a height of 140 mil+/−10 mil and has a dielectric constant of close to 1-1.05, and the WAIM layer is printed on a dielectric layer with a thickness typically up to 5 mil (e.g., 2 mil) and dielectric constant of around 4 (e.g., 3.5). For higher frequencies, the WAIM can be printed on low dielectric circuit board material e.g. 5-10 mil 5880 and placed directly on top of antenna aperture without a foam spacer.

The WAIM layer may be used in other types of cylindrically fed electronically beam scanning antennas, such as, for example, but not limited to phased array antennas, leaky-wave antennas, etc., to improve beam performance for H-pol. E-field at scan roll-off angles. Due to the scalability feature, it can be also used for different frequency bands (e.g., Ka-band, Ku-band, C-band, X-band, V-band, W-band, etc.).

Note that each specific antenna type, depending on the feed mechanism and operating concept, has its own radiating characteristics. Therefore, the design of a WAIM layer to work with any specific type of antenna is different. In one embodiment, a split ring resonator (SRR) WAIM layer with optimized geometry is designed to be used with cylindrically fed holographic antenna to resolve a H-pol scan roll-off problem.

Dipole Superstrate

A method and apparatus to change the frequency response (shifting down the resonant frequency) and to improve the radiation efficiency of holographic metasurface antennas by using a dipole patterned superstrate on top of the radiating aperture is described. This increases the loaded capacitance around an iris, which leads to shifting down the resonance frequency to the desired values, also reduces the ohmic loss in the basic unit cell and improves the radiation efficiency of the antenna and allows for post build frequency re-configurability of the a metasurface antenna, such as, for example, the antenna described above in FIG. 1A. Note that in one embodiment, the dipole substrate is used in conjunction with the wide-angle impedance matching networks described herein. While the dipole superstrate shifts down the frequency band of the antenna to the desirable one, the wide-angle impedance matching improves the radiation efficiency over the desired band at all scan angles. In other words, when the dipole superstrate is used with the wide-angle impedance matching network (e.g., shown in FIG. 1A), the dipole superstrate adjusts the frequency band of operation while the radiation efficiency improvement is achieved by impedance matching network.

The metasurface antennas may include lossy tunable materials that suffer from significant ohmic losses. Moreover, they may not operate over the desirable frequency band due to, for example, the limitations of manufacturing or any other practical reasons. However, in one embodiment, a parasitic element is used as a part of the basic design of the unit cell (e.g., a liquid crystal (LC)-based cell) of an antenna element to help to shift down the frequency band of operation, which also reduces the ohmic losses and enhances the radiated power in such antenna structures.

In one embodiment, a superstrate patterned with dipole elements is included on top of the radiating aperture (below any wide-angle impedance matching network) to adjust the frequency band of operation while the wide-angle impedance matching network improves the radiation efficiency at all scan angles. In one embodiment, this dipole patterned superstrate controls the axial ratio of the elliptically polarized antenna by adjusting the relative angle with respect to the slot of an antenna element and this holds true for all polarizations and scan angles.

Figure 5A:
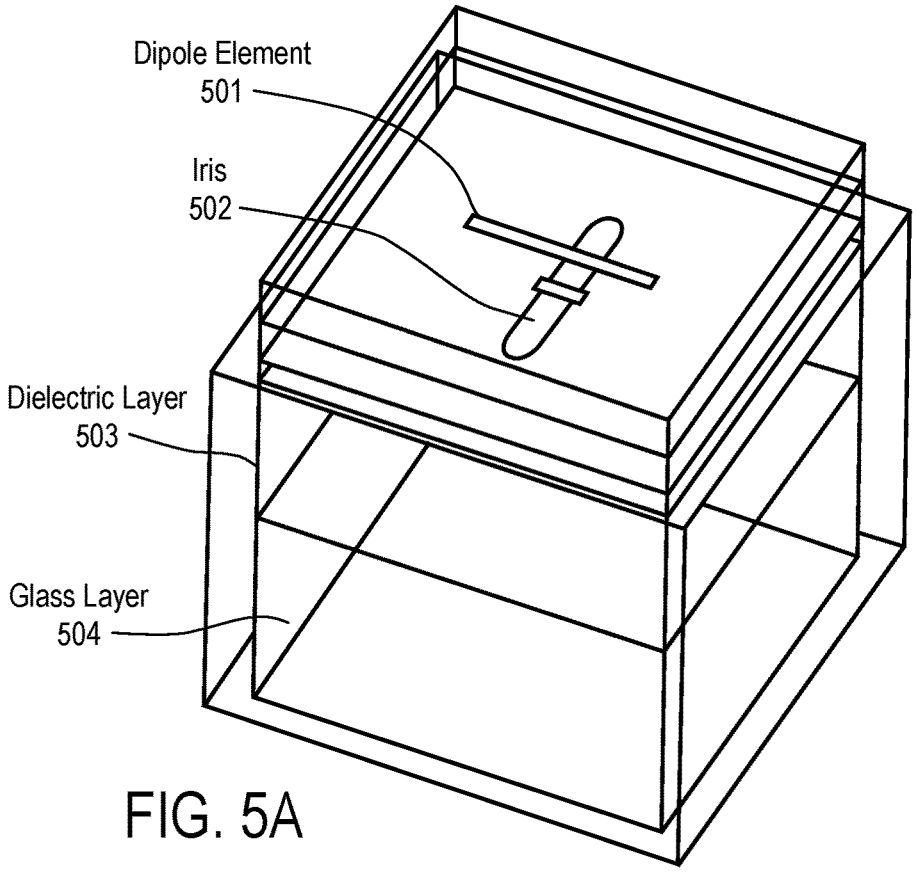
FIG. 5A illustrates an example of a dipole element aligned with an iris of an antenna element.

Embodiments of the dipole patterned substrate have one or more of the following advantages. One advantage is that it allows for post build frequency re-configurability of a metasurface antenna while improving the radiation efficiency and the dynamic bandwidth of the antenna. The presence of the dipole element in the vicinity of the unit cell loads the unit cell and helps to shift the frequency of the unit cell. This particular feature helps to operate the unit cells at variable resonance frequencies and hence control the tunable bandwidth, which in turn helps to improve the dynamic bandwidth of the antenna In one embodiment, the physical structure of the dipole element includes a metallic strip of desired electrical dimensions printed on a dielectric material and displaced a certain distance from the resonator for prescribed performance as shown in FIG. 5A. The dimensions and distances, including length and height of the dipole element, are chosen in such a way to avoid disturbing a characteristic of the antenna elements such as the resonance of the Rx irises of the Rx antenna elements. In another embodiment, the dimensions and distances are chosen to avoid disturbing a characteristic of the antenna elements such as the resonance of the Rx and Tx irises of the antenna elements.

Referring to FIG. 5A, a dipole element 501 is on a dielectric material 503 (e.g., a foam layer) and is positioned above and perpendicular to iris 502 of an antenna element. A glass layer 504 is between the iris ground and dielectric layer 503. Dipole element 501 comprises a rectangular metallic strip. The physical structure is not limited to rectangular strip and could be of any possible shape with desired electrical dimensions to provide the required frequency shift.

Figure 5B:
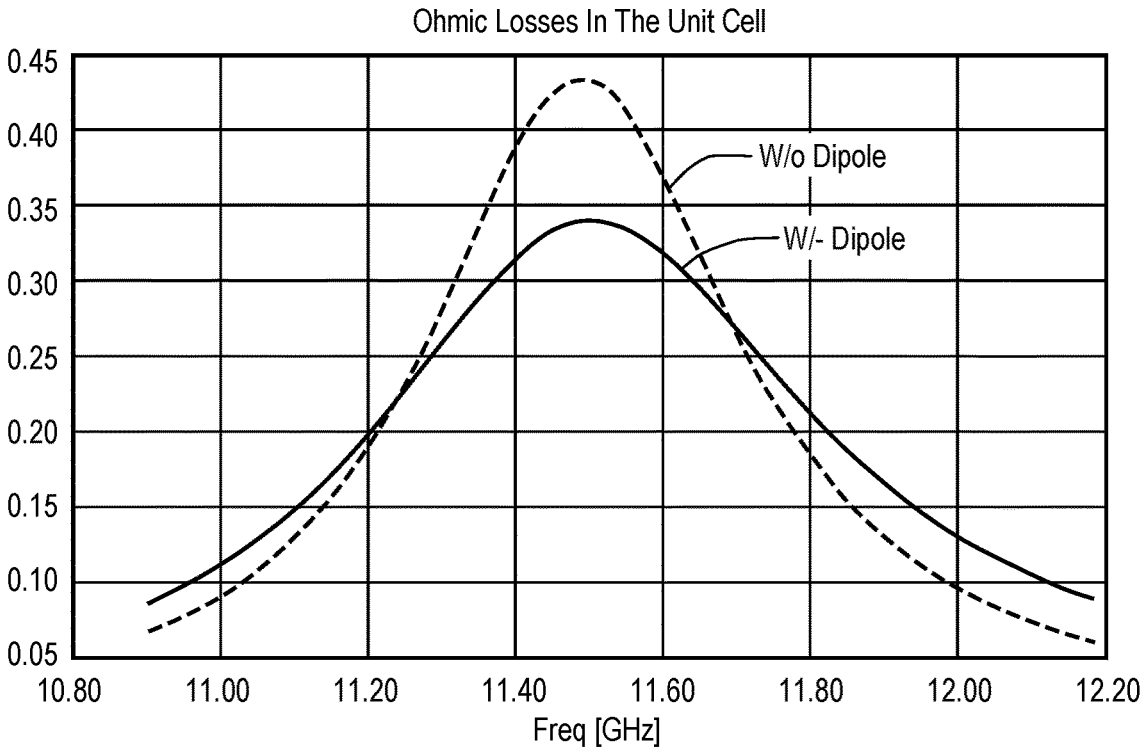
FIG. 5B illustrates a graph of ohmic losses in a unit cell with a dipole element and without a dipole element.

In one embodiment, due to switching speed requirements of the antenna, it is required to have very thin unit cell geometries. For example, in one embodiment, the distance between patch and iris ground is typically 1-10 microns (e.g., 3 microns). In such situations, the patch has to be very close to the iris ground, and the contribution of the patch to the radiated power is very limited due to the close proximity (typically a few microns) of the patch to the iris ground. Particularly, at resonance, the ohmic losses dominate resulting in poor radiation efficiencies. A way to improve the radiated power at/or near resonance in such cases is to use a parasitic element of sufficiently matched impedance to the unit cell which facilitates splitting the strong resonating current near the unit cell, thereby reducing the ohmic losses of the unit cell. The use of parasitic elements has two advantages, one helps to reduce the ohmic losses of the unit cell and also in the array environment of the antenna, a well-matched dipole element subsides the mutual coupling between the unit cells by reducing the internal coupling to contribute to more controlled aperture distributions on the antenna. FIG. 5B illustrates a graph of the ohmic losses in a unit cell with a dipole element and without a dipole element.

Figure 6A:
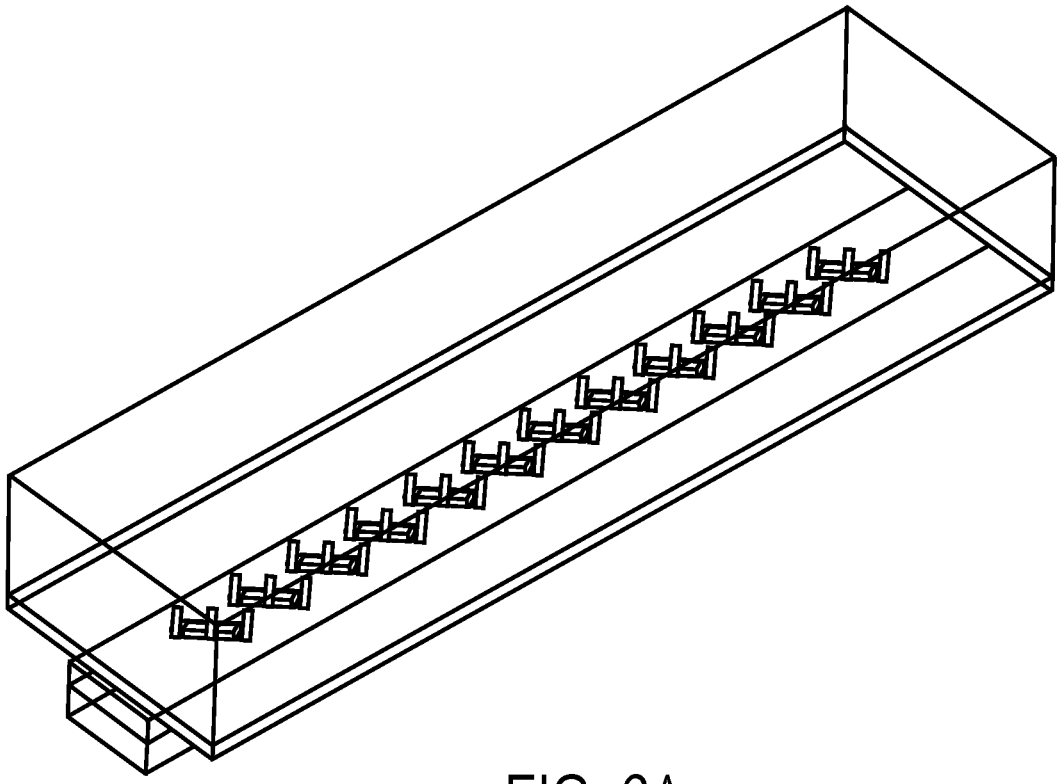
FIGS. 6A and 6B illustrate examples of multiple coplanar parasitic elements on a unit cell.
Figure 6B:
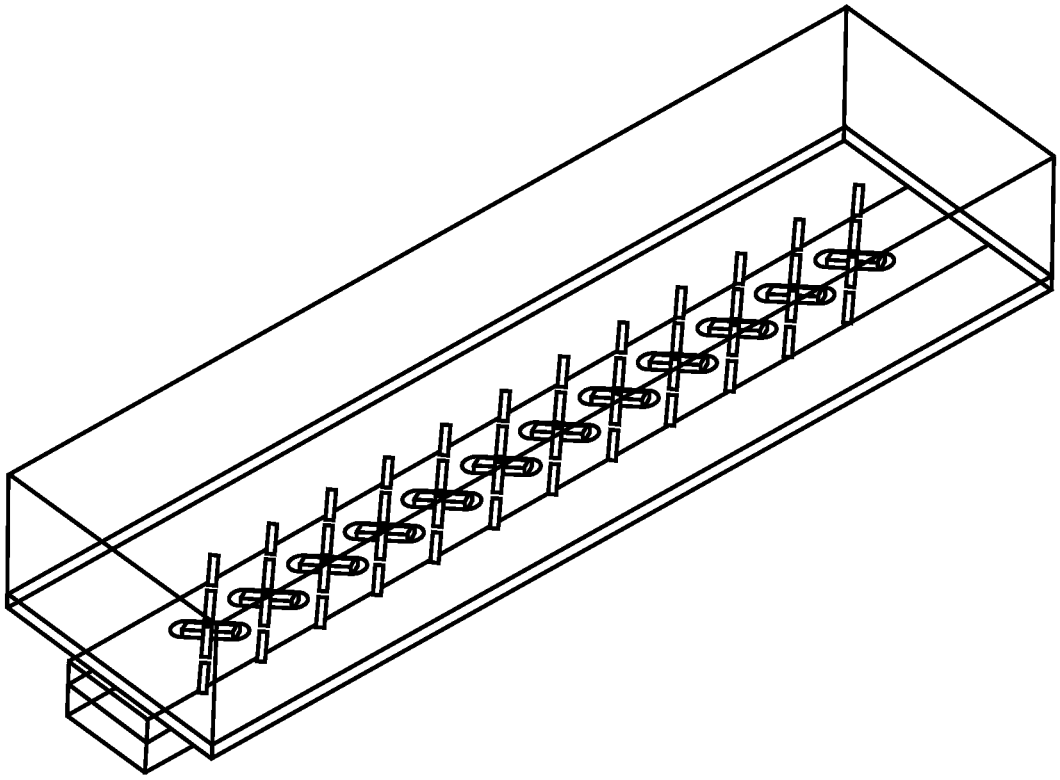

In one embodiment, multiple parasitic elements on the unit cell are used where the parasitic elements are in stacked geometries arranged on multiple dielectric layers of the unit cell. Another possible embodiment includes multiple coplanar parasitic elements on the unit cell. FIGS. 6A and 6B illustrate some examples of such arrangements.

The application of a slot-dipole element configuration to metasurface antennas enhances the radiation characteristics, particularly improving the radiation efficiency of the cell which is relatively lossy without a parasitic dipole on top of it. The enhancement of the radiation efficiency of the antenna for various scan angles also occurs. Also, the dipole can be used as an aid to shift the frequency band of operation after a post build process and also control the polarization of the antenna by adjusting the relative orientation of the dipole/dipoles with respect to each unit cell.

Liquid Crystal (LC)-Based Tunable Impedance Match Layer

The radiation characteristic of the antenna may change considerably depending on the scan angle, operating frequency, and polarization of the radiated field. The magnetic and electric impedance match layers above the antenna aperture can affect the magnetic and electric response of the antenna, respectively. As a result, making the impedance layers tunable provides a great capability to tailor antenna impedance (or performance) for magnetic or electric cases simultaneously or separately. Also, sometimes depending on circumstances or specifications, the antenna radiating characteristics should be tailored when it is in-use.

In one embodiment, the impedance matching metasurface layer uses liquid crystal (LC) material as the tuning component to tune the radiating performance at different scan angles. More specifically, in one embodiment, tuning is performed by using LC material at each cell element so that, by changing the dielectric constant of LC electronically, the electromagnetic characteristics of each element changes and consequently the equivalent surface impedance of the layer can be tailored. The LC material is included in one or more impedance match layers. For example, in a tunable WAIM metasurface consisting of ring shape elements, LC material is incorporated at each ring element to tune magnetic response of the antenna for horizontally polarized electric field radiation at extreme scan roll-off angles. As another example, a surface layer of LC-based tunable electric dipoles may be used to control the electric response of the antenna.

In one embodiment, a LC-based tunable impedance match layer is used on top of cylindrically fed holographic radial aperture. In one embodiment, the impedance match layers is a wide angle impedance match (WAIM) layer or a dipole screen layer or a combination of both. By tuning these layers, the magnetic and electric response of the antenna can be tuned simultaneously or separately.

In one embodiment, tunable impedance match layers are screen layers composed of periodic tunable radiating elements (e.g., dipoles, rings, etc.) such that, by these elements, the magnetic and electric frequency response of the antenna can be tailored over a quite broadband frequency range at different scan angles by changing the equivalent surface impedance of the metasurface. Thus, the tunable impedance match layers enable the performance of in-situ fine tuning at different scan angles and frequency bands to obtain improved performance of the antenna.

Figure 15:
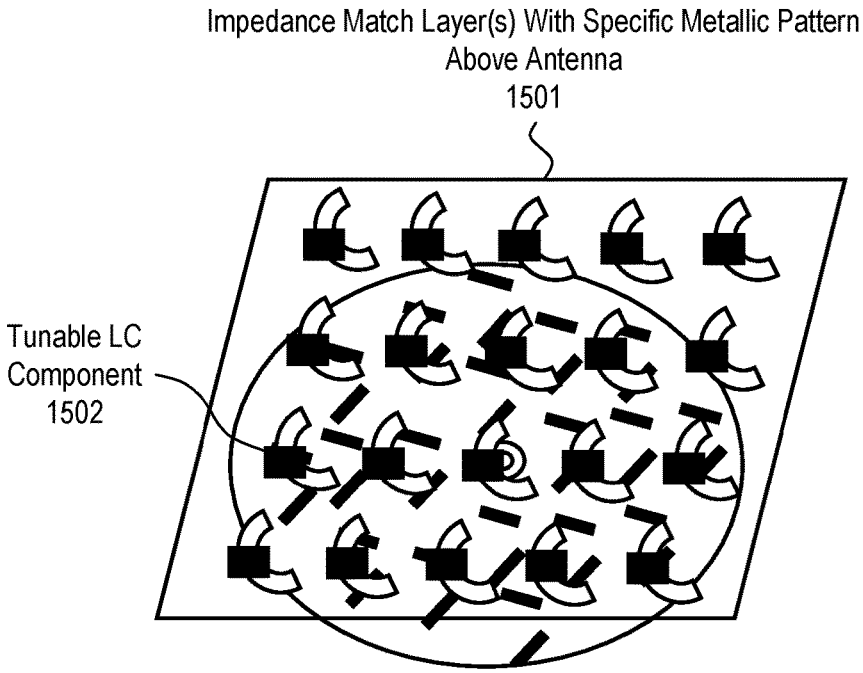
FIG. 15 illustrates one example of a very thin impedance match layer with tunable LC components over an antenna aperture.

FIG. 15 illustrates one example of a very thin impedance match layer with tunable LC components over an antenna aperture (e.g., a multiband cylindrically fed holographic antenna, etc.). In one embodiment, the impedance match layer, which may be a PCB, has a thickness of between 2 and 60 mil. In the case of a multiband cylindrically fed holographic antenna, the main beam is shaped by using proper excitation distribution for radiating irises and irises can be excited in such way to radiate horizontally or vertically polarized electric field at desired scan angles.

In one embodiment, the impedance match layer is one layer. In one embodiment, the LC-based tunable impedance match layers are simple thin layers that can be easily printed on any printed circuit board (PCB) or other substrate. However, the impedance match layer is not necessarily one layer. In another embodiment, the impedance match layer is a stacked up of several layers such that by using tunable LC material, the magnetic or electric response of corresponding layers can be tuned through a change in equivalent surface impedance.

Figure 16A:
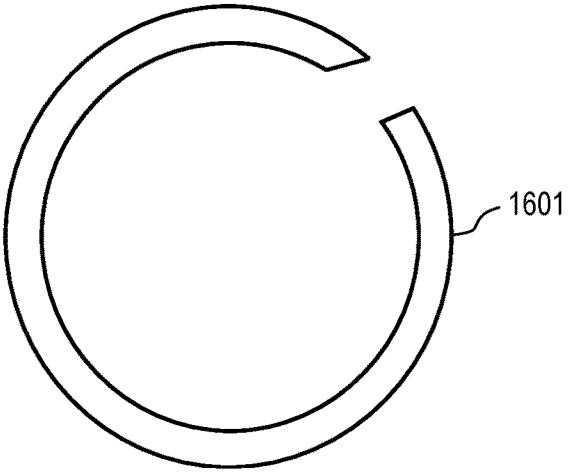
FIGS. 16A and 16B illustrate examples of rings that are used in a metallic pattern for impedance matching.
Figure 16B:
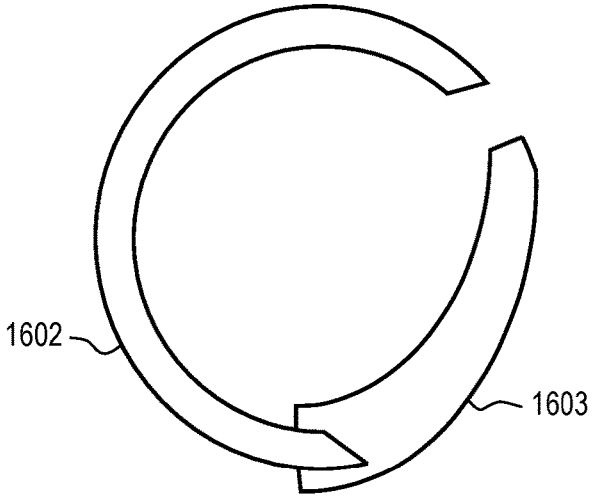

In one embodiment, the specific metallic pattern comprises one or more rings, such as the rings shown in FIGS. 16A and 16B. Referring to FIG. 16A, ring 1601 is a single piece. The ring in FIG. 16B comprise two parts with one end of each part overlapping. The two parts may be on opposite sides of the LC material, with the LC material being between the overlapped region of the two ends. Alternatively, in another embodiment, a periodic dipole could be used. In one embodiment, the rings are made of metal or any kind of highly conductive materials.

Note that the tunable impedance match layer may be used in all types of electronically beam scanning antennas to tune the antenna radiation characteristics for different polarizations, frequency bands and scan angles.

Examples of Antenna Embodiments

The techniques described above may be used with flat panel antennas. Embodiments of such flat panel antennas are disclosed. The flat panel antennas include one or more arrays of antenna elements on an antenna aperture. In one embodiment, the antenna elements comprise liquid crystal cells. In one embodiment, the flat panel antenna is a cylindrically fed antenna that includes matrix drive circuitry to uniquely address and drive each of the antenna elements that are not placed in rows and columns. In one embodiment, the elements are placed in rings.

In one embodiment, the antenna aperture having the one or more arrays of antenna elements is comprised of multiple segments coupled together. When coupled together, the combination of the segments form closed concentric rings of antenna elements. In one embodiment, the concentric rings are concentric with respect to the antenna feed.

Examples of Antenna Systems

In one embodiment, the flat panel antenna is part of a metamaterial antenna system. Embodiments of a metamaterial antenna system for communications satellite earth stations are described. In one embodiment, the antenna system is a component or subsystem of a satellite earth station (ES) operating on a mobile platform (e.g., aeronautical, maritime, land, etc.) that operates using either Ka-band frequencies or Ku-band frequencies for civil commercial satellite communications. Note that embodiments of the antenna system also can be used in earth stations that are not on mobile platforms (e.g., fixed or transportable earth stations).

In one embodiment, the antenna system uses surface scattering metamaterial technology to form and steer transmit and receive beams through separate antennas. In one embodiment, the antenna systems are analog systems, in contrast to antenna systems that employ digital signal processing to electrically form and steer beams (such as phased array antennas).

In one embodiment, the antenna system is comprised of three functional subsystems: (1) a wave guiding structure consisting of a cylindrical wave feed architecture; (2) an array of wave scattering metamaterial unit cells that are part of antenna elements; and (3) a control structure to command formation of an adjustable radiation field (beam) from the metamaterial scattering elements using holographic principles.

Antenna Elements

In one embodiment, the antenna elements comprise a group of patch antennas. This group of patch antennas comprises an array of scattering metamaterial elements. In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor. As would be understood by those skilled in the art, LC in the context of CELC refers to inductance-capacitance, as opposed to liquid crystal.

In one embodiment, a liquid crystal (LC) is disposed in the gap around the scattering element. This LC is driven by the direct drive embodiments described above. In one embodiment, liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, in one embodiment, the liquid crystal integrates an on/off switch for the transmission of energy from the guided wave to the CELC. When switched on, the CELC emits an electromagnetic wave like an electrically small dipole antenna. Note that the teachings herein are not limited to having a liquid crystal that operates in a binary fashion with respect to energy transmission.

In one embodiment, the feed geometry of this antenna system allows the antenna elements to be positioned at forty-five degree (45°) angles to the vector of the wave in the wave feed. Note that other positions may be used (e.g., at 40° angles). This position of the elements enables control of the free space wave received by or transmitted/radiated from the elements. In one embodiment, the antenna elements are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼ the 10 mm free-space wavelength of 30 GHz).

In one embodiment, the two sets of elements are perpendicular to each other and simultaneously have equal amplitude excitation if controlled to the same tuning state. Rotating them +/−45 degrees relative to the feed wave excitation achieves both desired features at once. Rotating one set 0 degrees and the other 90 degrees would achieve the perpendicular goal, but not the equal amplitude excitation goal. Note that 0 and 90 degrees may be used to achieve isolation when feeding the array of antenna elements in a single structure from two sides.

The amount of radiated power from each unit cell is controlled by applying a voltage to the patch (potential across the LC channel) using a controller. Traces to each patch are used to provide the voltage to the patch antenna. The voltage is used to tune or detune the capacitance and thus the resonance frequency of individual elements to effectuate beam forming. The voltage required is dependent on the liquid crystal mixture being used. The voltage tuning characteristic of liquid crystal mixtures is mainly described by a threshold voltage at which the liquid crystal starts to be affected by the voltage and the saturation voltage, above which an increase of the voltage does not cause major tuning in liquid crystal. These two characteristic parameters can change for different liquid crystal mixtures.

In one embodiment, as discussed above, a matrix drive is used to apply voltage to the patches in order to drive each cell separately from all the other cells without having a separate connection for each cell (direct drive). Because of the high density of elements, the matrix drive is an efficient way to address each cell individually.

In one embodiment, the control structure for the antenna system has 2 main components: the antenna array controller, which includes drive electronics, for the antenna system, is below the wave scattering structure, while the matrix drive switching array is interspersed throughout the radiating RF array in such a way as to not interfere with the radiation. In one embodiment, the drive electronics for the antenna system comprise commercial off-the shelf LCD controls used in commercial television appliances that adjust the bias voltage for each scattering element by adjusting the amplitude or duty cycle of an AC bias signal to that element.

In one embodiment, the antenna array controller also contains a microprocessor executing the software. The control structure may also incorporate sensors (e.g., a GPS receiver, a three-axis compass, a 3-axis accelerometer, 3-axis gyro, 3-axis magnetometer, etc.) to provide location and orientation information to the processor. The location and orientation information may be provided to the processor by other systems in the earth station and/or may not be part of the antenna system.

More specifically, the antenna array controller controls which elements are turned off and those elements turned on and at which phase and amplitude level at the frequency of operation. The elements are selectively detuned for frequency operation by voltage application.

For transmission, a controller supplies an array of voltage signals to the RF patches to create a modulation, or control pattern. The control pattern causes the elements to be turned to different states. In one embodiment, multistate control is used in which various elements are turned on and off to varying levels, further approximating a sinusoidal control pattern, as opposed to a square wave (i.e., a sinusoid gray shade modulation pattern). In one embodiment, some elements radiate more strongly than others, rather than some elements radiate and some do not. Variable radiation is achieved by applying specific voltage levels, which adjusts the liquid crystal permittivity to varying amounts, thereby detuning elements variably and causing some elements to radiate more than others.

The generation of a focused beam by the metamaterial array of elements can be explained by the phenomenon of constructive and destructive interference. Individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be pointed theoretically in any direction plus or minus ninety degrees (90°) from the bore sight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the main beam. The time required to turn the unit cells on and off dictates the speed at which the beam can be switched from one location to another location.

In one embodiment, the antenna system produces one steerable beam for the uplink antenna and one steerable beam for the downlink antenna. In one embodiment, the antenna system uses metamaterial technology to receive beams and to decode signals from the satellite and to form transmit beams that are directed toward the satellite. In one embodiment, the antenna systems are analog systems, in contrast to antenna systems that employ digital signal processing to electrically form and steer beams (such as phased array antennas). In one embodiment, the antenna system is considered a "surface" antenna that is planar and relatively low profile, especially when compared to conventional satellite dish receivers.

Figure 7:
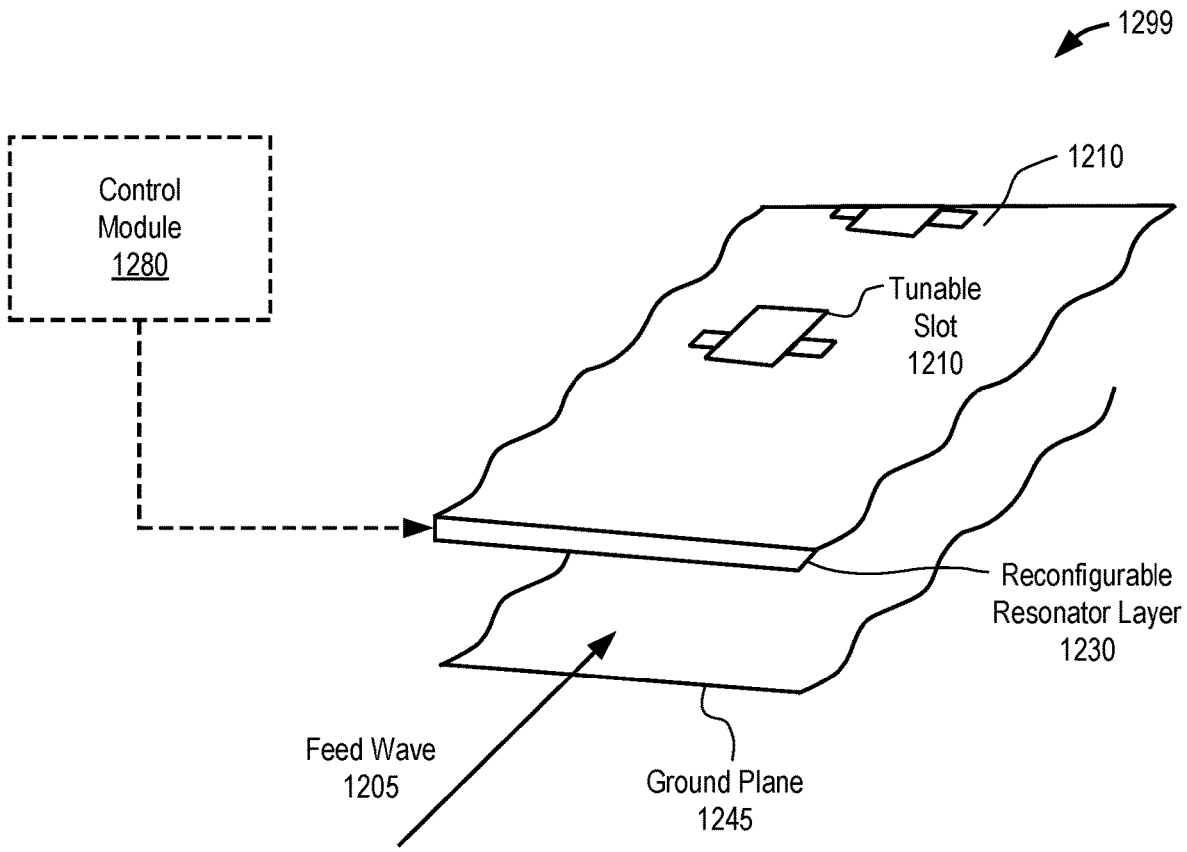
FIG. 7 illustrates a perspective view of one row of antenna elements that includes a ground plane and a reconfigurable resonator layer.

FIG. 7 illustrates a perspective view of one row of antenna elements that includes a ground plane and a reconfigurable resonator layer. Reconfigurable resonator layer 1230 includes an array of tunable slots 1210. The array of tunable slots 1210 can be configured to point the antenna in a desired direction. Each of the tunable slots can be tuned/adjusted by varying a voltage across the liquid crystal.

Figure 8A:
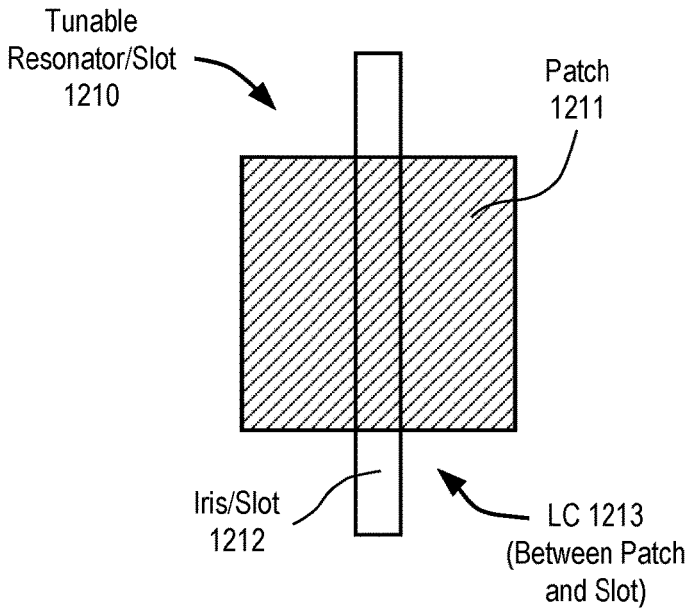
FIG. 8A illustrates one embodiment of a tunable resonator/slot.

Control module 1280 is coupled to reconfigurable resonator layer 1230 to modulate the array of tunable slots 1210 by varying the voltage across the liquid crystal in FIG. 8A. Control module 1280 may include a Field Programmable Gate Array ("FPGA"), a microprocessor, a controller, System-on-a-Chip (SoC), or other processing logic. In one embodiment, control module 1280 includes logic circuitry (e.g., multiplexer) to drive the array of tunable slots 1210. In one embodiment, control module 1280 receives data that includes specifications for a holographic diffraction pattern to be driven onto the array of tunable slots 1210. The holographic diffraction patterns may be generated in response to a spatial relationship between the antenna and a satellite so that the holographic diffraction pattern steers the downlink beams (and uplink beam if the antenna system performs transmit) in the appropriate direction for communication. Although not drawn in each figure, a control module similar to control module 1280 may drive each array of tunable slots described in the figures of the disclosure.

Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 1205 (approximately 20 GHz in some embodiments). To transform a feed wave into a radiated beam (either for transmitting or receiving purposes), an interference pattern is calculated between the desired RF beam (the object beam) and the feed wave (the reference beam). The interference pattern is driven onto the array of tunable slots 1210 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system. The holographic diffraction pattern contains the excitation of each element and is calculated by $w_{hologram}=w_{in}*w_{out}$, with $w_{in}$ as the wave equation in the waveguide and $w_{out}$ the wave equation on the outgoing wave.

FIG. 8A illustrates one embodiment of a tunable resonator/slot 1210. Tunable slot 1210 includes an iris/slot 1212, a radiating patch 1211, and liquid crystal 1213 disposed between iris 1212 and patch 1211. In one embodiment, radiating patch 1211 is co-located with iris 1212.

Figure 8B:
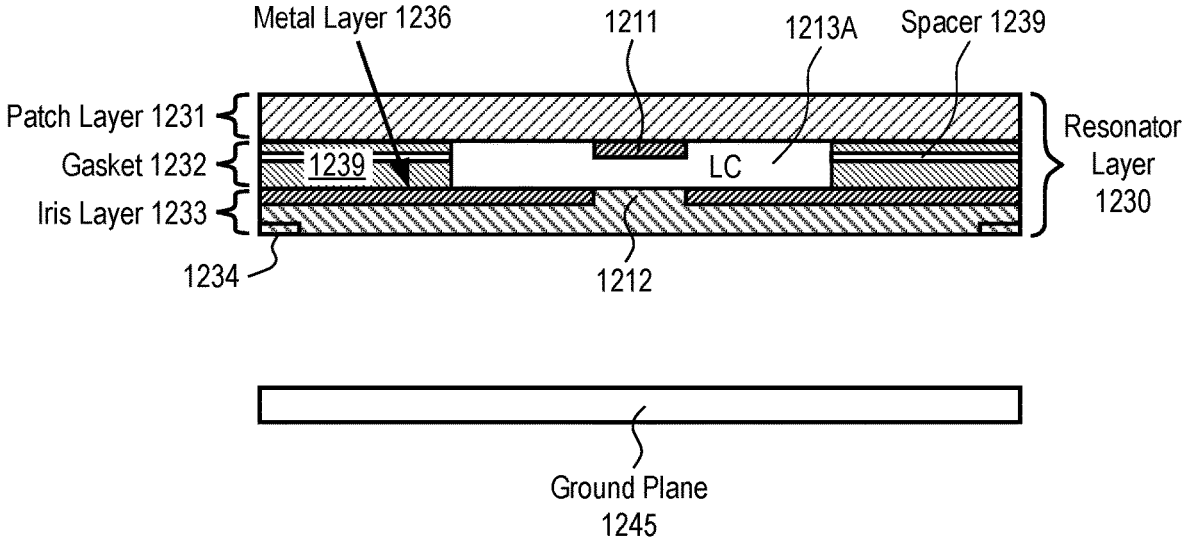
FIG. 8B illustrates a cross section view of one embodiment of a physical antenna aperture.

FIG. 8B illustrates a cross section view of one embodiment of a physical antenna aperture. The antenna aperture includes ground plane 1245, and a metal layer 1236 within iris layer 1233, which is included in reconfigurable resonator layer 1230. In one embodiment, the antenna aperture of FIG. 8B includes a plurality of tunable resonator/slots 1210 of FIG. 8A. Iris/slot 1212 is defined by openings in metal layer 1236. A feed wave, such as feed wave 1205 of FIG. 8A, may have a microwave frequency compatible with satellite communication channels. The feed wave propagates between ground plane 1245 and resonator layer 1230.

Reconfigurable resonator layer 1230 also includes gasket layer 1232 and patch layer 1231. Gasket layer 1232 is disposed between patch layer 1231 and iris layer 1233. Note that in one embodiment, a spacer could replace gasket layer 1232. In one embodiment, iris layer 1233 is a printed circuit board ("PCB") that includes a copper layer as metal layer 1236. In one embodiment, iris layer 1233 is glass. Iris layer 1233 may be other types of substrates.

Openings may be etched in the copper layer to form slots 1212. In one embodiment, iris layer 1233 is conductively coupled by a conductive bonding layer to another structure (e.g., a waveguide) in FIG. 8B. Note that in an embodiment the iris layer is not conductively coupled by a conductive bonding layer and is instead interfaced with a non-conducting bonding layer.

Patch layer 1231 may also be a PCB that includes metal as radiating patches 1211. In one embodiment, gasket layer 1232 includes spacers 1239 that provide a mechanical standoff to define the dimension between metal layer 1236 and patch 1211. In one embodiment, the spacers are 75 microns, but other sizes may be used (e.g., 3-200 mm). As mentioned above, in one embodiment, the antenna aperture of FIG. 8B includes multiple tunable resonator/slots, such as tunable resonator/slot 1210 includes patch 1211, liquid crystal 1213, and iris 1212 of FIG. 8A. The chamber for liquid crystal 1213 is defined by spacers 1239, iris layer 1233 and metal layer 1236. When the chamber is filled with liquid crystal, patch layer 1231 can be laminated onto spacers 1239 to seal liquid crystal within resonator layer 1230.

A voltage between patch layer 1231 and iris layer 1233 can be modulated to tune the liquid crystal in the gap between the patch and the slots (e.g., tunable resonator/slot 1210). Adjusting the voltage across liquid crystal 1213 varies the capacitance of a slot (e.g., tunable resonator/slot 1210). Accordingly, the reactance of a slot (e.g., tunable resonator/slot 1210) can be varied by changing the capacitance. Resonant frequency of slot 1210 also changes according to the equation $$f = \frac{1}{2\pi\sqrt{LC}}$$

where f is the resonant frequency of slot 1210 and L and C are the inductance and capacitance of slot 1210, respectively. The resonant frequency of slot 1210 affects the energy radiated from feed wave 1205 propagating through the waveguide. As an example, if feed wave 1205 is 20 GHz, the resonant frequency of a slot 1210 may be adjusted (by varying the capacitance) to 17 GHz so that the slot 1210 couples substantially no energy from feed wave 1205. Or, the resonant frequency of a slot 1210 may be adjusted to 20 GHz so that the slot 1210 couples energy from feed wave 1205 and radiates that energy into free space. Although the examples given are binary (fully radiating or not radiating at all), full gray scale control of the reactance, and therefore the resonant frequency of slot 1210 is possible with voltage variance over a multi-valued range. Hence, the energy radiated from each slot 1210 can be finely controlled so that detailed holographic diffraction patterns can be formed by the array of tunable slots.

In one embodiment, tunable slots in a row are spaced from each other by λ/5. Other spacings may be used. In one embodiment, each tunable slot in a row is spaced from the closest tunable slot in an adjacent row by λ/2, and, thus, commonly oriented tunable slots in different rows are spaced by λ/4, though other spacings are possible (e.g., λ/5, λ/6.3). In another embodiment, each tunable slot in a row is spaced from the closest tunable slot in an adjacent row by λ/3.

Embodiments use reconfigurable metamaterial technology, such as described in U.S. patent application Ser. No. 14/550,178, entitled "Dynamic Polarization and Coupling Control from a Steerable Cylindrically Fed Holographic Antenna", filed Nov. 21, 2014 and U.S. patent application Ser. No. 14/610,502, entitled "Ridged Waveguide Feed Structures for Reconfigurable Antenna", filed Jan. 30, 2015.

FIGS. 9A-D illustrate one embodiment of the different layers for creating the slotted array. The antenna array includes antenna elements that are positioned in rings, such as the example rings shown in FIG. 1A. Note that in this example the antenna array has two different types of antenna elements that are used for two different types of frequency bands.

Figure 9A:
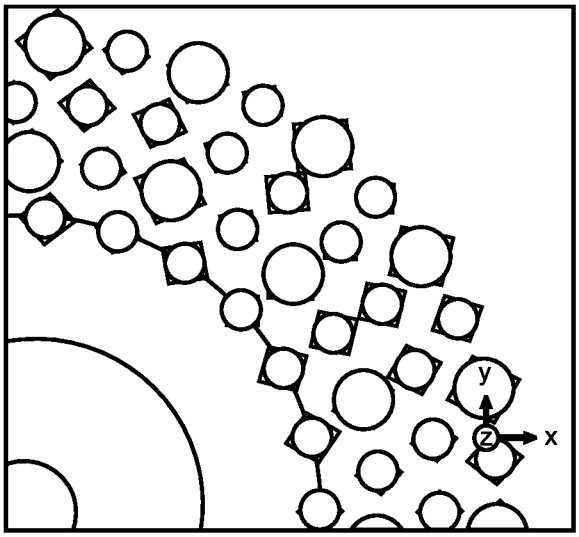
FIGS. 9A-D illustrate one embodiment of the different layers for creating the slotted array.
Figure 9B:
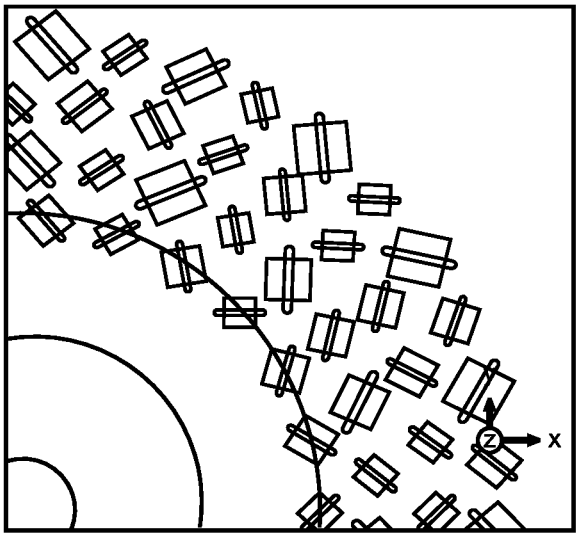
Figure 9C:
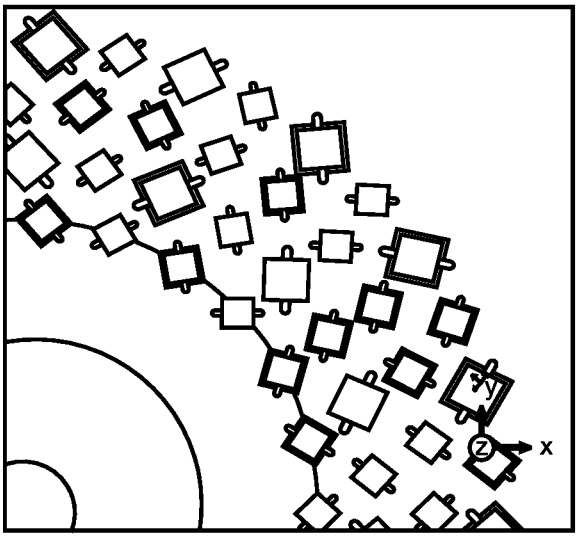
Figure 9D:
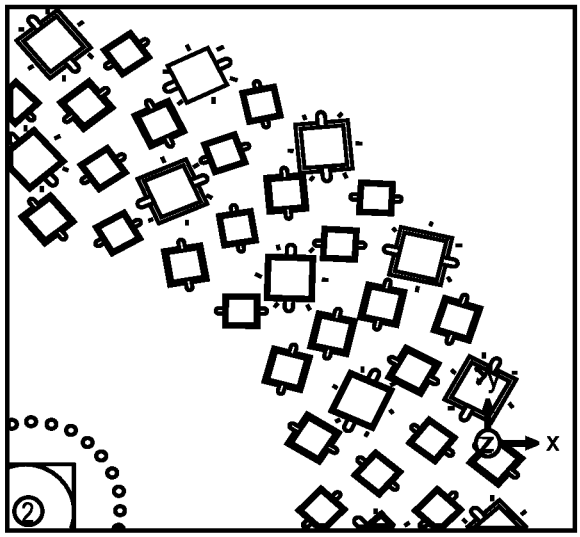

FIG. 9A illustrates a portion of the first iris board layer with locations corresponding to the slots. Referring to FIG. 9A, the circles are open areas/slots in the metallization in the bottom side of the iris substrate, and are for controlling the coupling of elements to the feed (the feed wave). Note that this layer is an optional layer and is not used in all designs. FIG. 9B illustrates a portion of the second iris board layer containing slots. FIG. 9C illustrates patches over a portion of the second iris board layer. FIG. 9D illustrates a top view of a portion of the slotted array.

Figure 10:
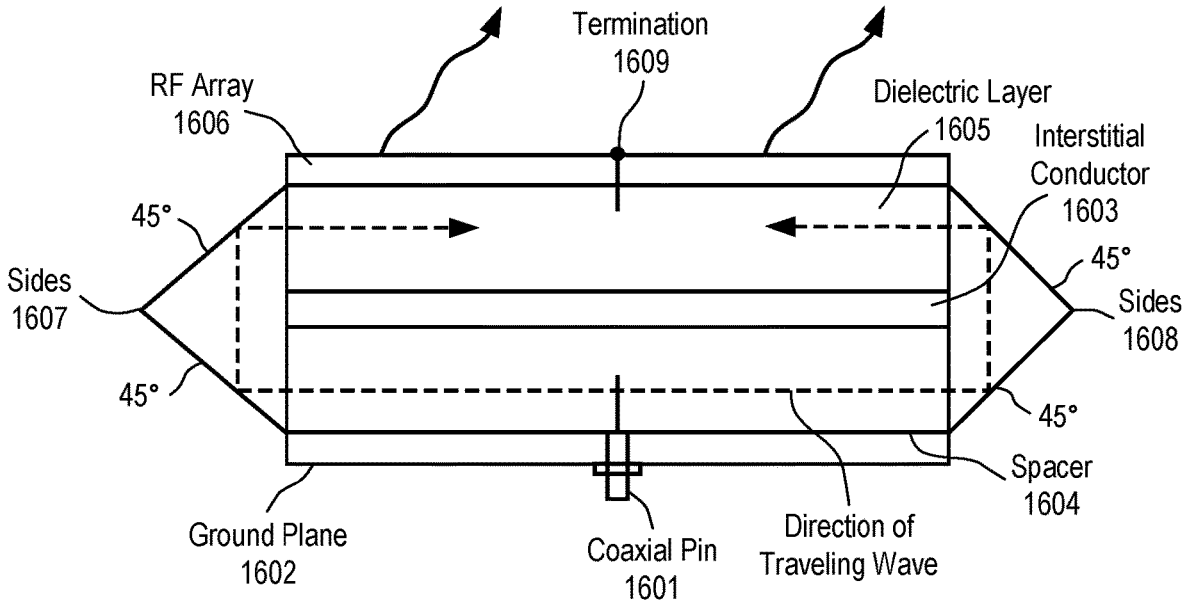
FIG. 10 illustrates a side view of one embodiment of a cylindrically fed antenna structure.

FIG. 10 illustrates a side view of one embodiment of a cylindrically fed antenna structure. The antenna produces an inwardly travelling wave using a double layer feed structure (i.e., two layers of a feed structure). In one embodiment, the antenna includes a circular outer shape, though this is not required. That is, non-circular inward travelling structures can be used. In one embodiment, the antenna structure in FIG. 10 includes a coaxial feed, such as, for example, described in U.S. Publication No. 2015/0236412, entitled "Dynamic Polarization and Coupling Control from a Steerable Cylindrically Fed Holographic Antenna", filed on Nov. 21, 2014.

Referring to FIG. 10, a coaxial pin 1601 is used to excite the field on the lower level of the antenna. In one embodiment, coaxial pin 1601 is a 50Ω coax pin that is readily available. Coaxial pin 1601 is coupled (e.g., bolted) to the bottom of the antenna structure, which is conducting ground plane 1602.

Separate from conducting ground plane 1602 is interstitial conductor 1603, which is an internal conductor. In one embodiment, conducting ground plane 1602 and interstitial conductor 1603 are parallel to each other. In one embodiment, the distance between ground plane 1602 and interstitial conductor 1603 is 0.1-0.15". In another embodiment, this distance may be $\lambda/2$, where $\lambda$ is the wavelength of the travelling wave at the frequency of operation.

Ground plane 1602 is separated from interstitial conductor 1603 via a spacer 1604. In one embodiment, spacer 1604 is a foam or air-like spacer. In one embodiment, spacer 1604 comprises a plastic spacer.

On top of interstitial conductor 1603 is dielectric layer 1605. In one embodiment, dielectric layer 1605 is plastic. The purpose of dielectric layer 1605 is to slow the travelling wave relative to free space velocity. In one embodiment, dielectric layer 1605 slows the travelling wave by 30% relative to free space. In one embodiment, the range of indices of refraction that are suitable for beam forming are 1.2-1.8, where free space has by definition an index of refraction equal to 1. Other dielectric spacer materials, such as, for example, plastic, may be used to achieve this effect. Note that materials other than plastic may be used as long as they achieve the desired wave slowing effect. Alternatively, a material with distributed structures may be used as dielectric 1605, such as periodic sub-wavelength metallic structures that can be machined or lithographically defined, for example.

An RF-array 1606 is on top of dielectric 1605. In one embodiment, the distance between interstitial conductor 1603 and RF-array 1606 is 0.1-0.15". In another embodiment, this distance may be $\lambda_{eff}/2$, where $\lambda_{eff}$ is the effective wavelength in the medium at the design frequency.

The antenna includes sides 1607 and 1608. Sides 1607 and 1608 are angled to cause a travelling wave feed from coax pin 1601 to be propagated from the area below interstitial conductor 1603 (the spacer layer) to the area above interstitial conductor 1603 (the dielectric layer) via reflection. In one embodiment, the angle of sides 1607 and 1608 are at 45° angles. In an alternative embodiment, sides 1607 and 1608 could be replaced with a continuous radius to achieve the reflection. While FIG. 10 shows angled sides that have angle of 45 degrees, other angles that accomplish signal transmission from lower level feed to upper level feed may be used. That is, given that the effective wavelength in the lower feed will generally be different than in the upper feed, some deviation from the ideal 45° angles could be used to aid transmission from the lower to the upper feed level. For example, in another embodiment, the 45° angles are replaced with a single step. The steps on one end of the antenna go around the dielectric layer, interstitial the conductor, and the spacer layer. The same two steps are at the other ends of these layers.

In operation, when a feed wave is fed in from coaxial pin 1601, the wave travels outward concentrically oriented from coaxial pin 1601 in the area between ground plane 1602 and interstitial conductor 1603. The concentrically outgoing waves are reflected by sides 1607 and 1608 and travel inwardly in the area between interstitial conductor 1603 and RF array 1606. The reflection from the edge of the circular perimeter causes the wave to remain in phase (i.e., it is an in-phase reflection). The travelling wave is slowed by dielectric layer 1605. At this point, the travelling wave starts interacting and exciting with elements in RF array 1606 to obtain the desired scattering.

To terminate the travelling wave, a termination 1609 is included in the antenna at the geometric center of the antenna. In one embodiment, termination 1609 comprises a pin termination (e.g., a 50Ω pin). In another embodiment, termination 1609 comprises an RF absorber that terminates unused energy to prevent reflections of that unused energy back through the feed structure of the antenna. These could be used at the top of RF array 1606.

Figure 11:
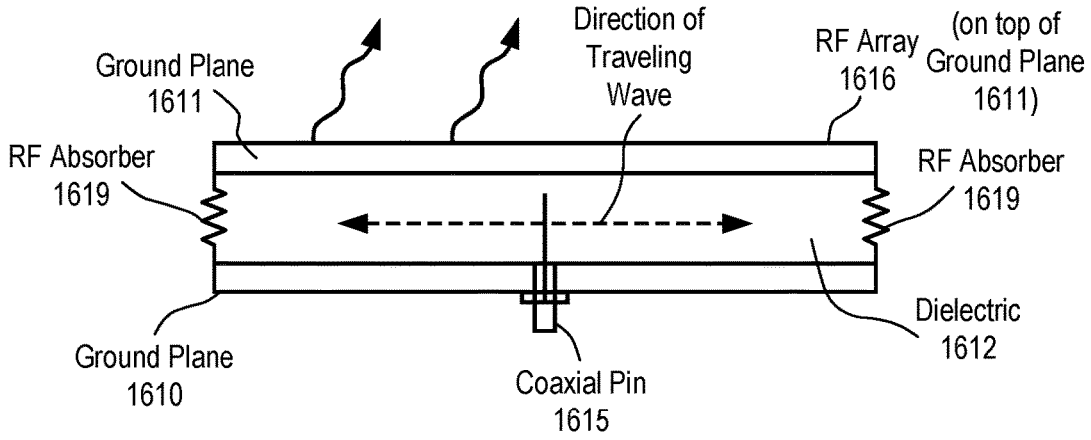
FIG. 11 illustrates another embodiment of the antenna system with an outgoing wave.

FIG. 11 illustrates another embodiment of the antenna system with an outgoing wave. Referring to FIG. 11, two ground planes 1610 and 1611 are substantially parallel to each other with a dielectric layer 1612 (e.g., a plastic layer, etc.) in between ground planes. RF absorbers 1619 (e.g., resistors) couple the two ground planes 1610 and 1611 together. A coaxial pin 1615 (e.g., 50Ω) feeds the antenna. An RF array 1616 is on top of dielectric layer 1612 and ground plane 1611.

In operation, a feed wave is fed through coaxial pin 1615 and travels concentrically outward and interacts with the elements of RF array 1616.

The cylindrical feed in both the antennas of FIGS. 10 and 11 improves the service angle of the antenna. Instead of a service angle of plus or minus forty-five degrees azimuth (±45° Az) and plus or minus twenty-five degrees elevation (±25° El), in one embodiment, the antenna system has a service angle of seventy-five degrees (75°) from the bore sight in all directions. As with any beam forming antenna comprised of many individual radiators, the overall antenna gain is dependent on the gain of the constituent elements, which themselves are angle-dependent. When using common radiating elements, the overall antenna gain typically decreases as the beam is pointed further off bore sight. At 75 degrees off bore sight, significant gain degradation of about 6 dB is expected.

Embodiments of the antenna having a cylindrical feed solve one or more problems. These include dramatically simplifying the feed structure compared to antennas fed with a corporate divider network and therefore reducing total required antenna and antenna feed volume; decreasing sensitivity to manufacturing and control errors by maintaining high beam performance with coarser controls (extending all the way to simple binary control); giving a more advantageous side lobe pattern compared to rectilinear feeds because the cylindrically oriented feed waves result in spatially diverse side lobes in the far field; and allowing polarization to be dynamic, including allowing left-hand circular, right-hand circular, and linear polarizations, while not requiring a polarizer.

Array of Wave Scattering Elements

RF array 1606 of FIG. 10 and RF array 1616 of FIG. 11 include a wave scattering subsystem that includes a group of patch antennas (i.e., scatterers) that act as radiators. This group of patch antennas comprises an array of scattering metamaterial elements.

In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor.

In one embodiment, a liquid crystal (LC) is injected in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, the liquid crystal acts as an on/off switch for the transmission of energy from the guided wave to the CELC. When switched on, the CELC emits an electromagnetic wave like an electrically small dipole antenna.

Controlling the thickness of the LC increases the beam switching speed. A fifty percent (50%) reduction in the gap between the lower and the upper conductor (the thickness of the liquid crystal) results in a fourfold increase in speed. In another embodiment, the thickness of the liquid crystal results in a beam switching speed of approximately fourteen milliseconds (14 ms). In one embodiment, the LC is doped in a manner well-known in the art to improve responsiveness so that a seven millisecond (7 ms) requirement can be met.

The CELC element is responsive to a magnetic field that is applied parallel to the plane of the CELC element and perpendicular to the CELC gap complement. When a voltage is applied to the liquid crystal in the metamaterial scattering unit cell, the magnetic field component of the guided wave induces a magnetic excitation of the CELC, which, in turn, produces an electromagnetic wave in the same frequency as the guided wave.

The phase of the electromagnetic wave generated by a single CELC can be selected by the position of the CELC on the vector of the guided wave. Each cell generates a wave in phase with the guided wave parallel to the CELC. Because the CELCs are smaller than the wave length, the output wave has the same phase as the phase of the guided wave as it passes beneath the CELC.

In one embodiment, the cylindrical feed geometry of this antenna system allows the CELC elements to be positioned at forty-five degree (45°) angles to the vector of the wave in the wave feed. This position of the elements enables control of the polarization of the free space wave generated from or received by the elements. In one embodiment, the CELCs are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼ the 10 mm free-space wavelength of 30 GHz).

In one embodiment, the CELCs are implemented with patch antennas that include a patch co-located over a slot with liquid crystal between the two. In this respect, the metamaterial antenna acts like a slotted (scattering) wave guide. With a slotted wave guide, the phase of the output wave depends on the location of the slot in relation to the guided wave.

Cell Placement

Figure 12:
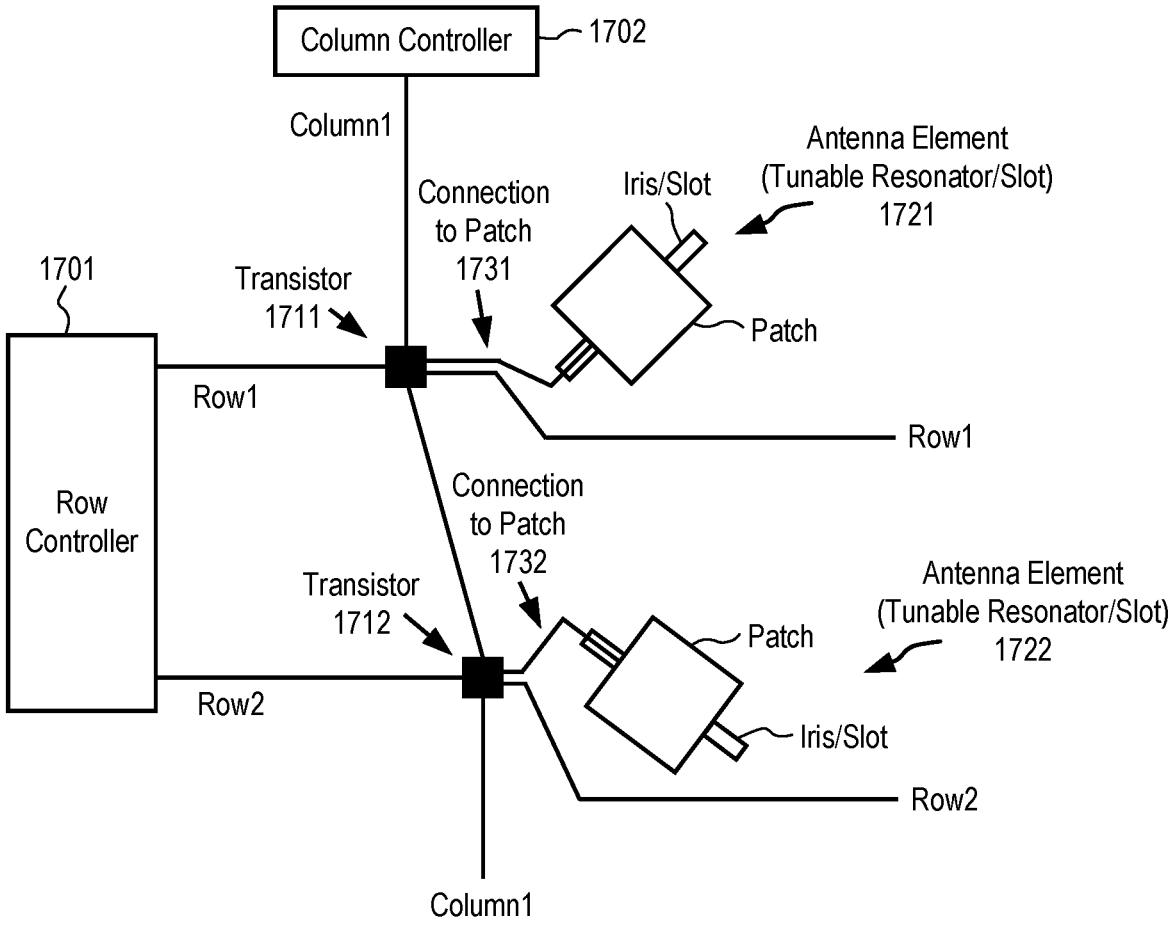
FIG. 12 illustrates one embodiment of the placement of matrix drive circuitry with respect to antenna elements.

In one embodiment, the antenna elements are placed on the cylindrical feed antenna aperture in a way that allows for a systematic matrix drive circuit. The placement of the cells includes placement of the transistors for the matrix drive. FIG. 12 illustrates one embodiment of the placement of matrix drive circuitry with respect to antenna elements. Referring to FIG. 12, row controller 1701 is coupled to transistors 1711 and 1712, via row select signals Row1 and Row2, respectively, and column controller 1702 is coupled to transistors 1711 and 1712 via column select signal Column1. Transistor 1711 is also coupled to antenna element 1721 via connection to patch 1731, while transistor 1712 is coupled to antenna element 1722 via connection to patch 1732.

In an initial approach to realize matrix drive circuitry on the cylindrical feed antenna with unit cells placed in a non-regular grid, two steps are performed. In the first step, the cells are placed on concentric rings and each of the cells is connected to a transistor that is placed beside the cell and acts as a switch to drive each cell separately. In the second step, the matrix drive circuitry is built in order to connect every transistor with a unique address as the matrix drive approach requires. Because the matrix drive circuit is built by row and column traces (similar to LCDs) but the cells are placed on rings, there is no systematic way to assign a unique address to each transistor. This mapping problem results in very complex circuitry to cover all the transistors and leads to a significant increase in the number of physical traces to accomplish the routing. Because of the high density of cells, those traces disturb the RF performance of the antenna due to coupling effect. Also, due to the complexity of traces and high packing density, the routing of the traces cannot be accomplished by commercially available layout tools.

In one embodiment, the matrix drive circuitry is predefined before the cells and transistors are placed. This ensures a minimum number of traces that are necessary to drive all the cells, each with a unique address. This strategy reduces the complexity of the drive circuitry and simplifies the routing, which subsequently improves the RF performance of the antenna.

More specifically, in one approach, in the first step, the cells are placed on a regular rectangular grid composed of rows and columns that describe the unique address of each cell. In the second step, the cells are grouped and transformed to concentric circles while maintaining their address and connection to the rows and columns as defined in the first step. A goal of this transformation is not only to put the cells on rings but also to keep the distance between cells and the distance between rings constant over the entire aperture. In order to accomplish this goal, there are several ways to group the cells.

Figure 13:
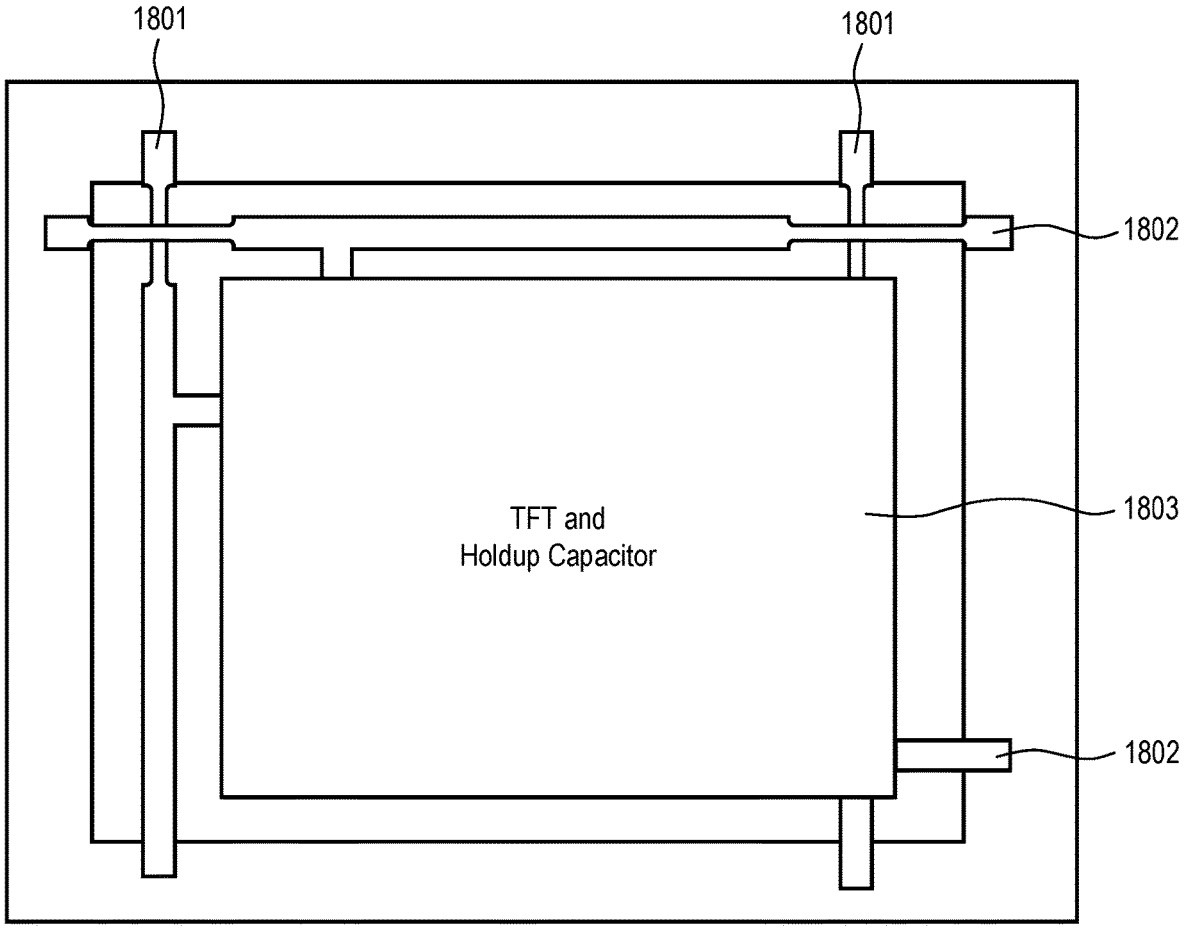
FIG. 13 illustrates one embodiment of a TFT package.

In one embodiment, a TFT package is used to enable placement and unique addressing in the matrix drive. FIG. 13 illustrates one embodiment of a TFT package. Referring to FIG. 13, a TFT and a hold capacitor 1803 is shown with input and output ports. There are two input ports connected to traces 1801 and two output ports connected to traces 1802 to connect the TFTs together using the rows and columns. In one embodiment, the row and column traces cross in 90° angles to reduce, and potentially minimize, the coupling between the row and column traces. In one embodiment, the row and column traces are on different layers.

An Example of a Full Duplex Communication System

Figure 14:
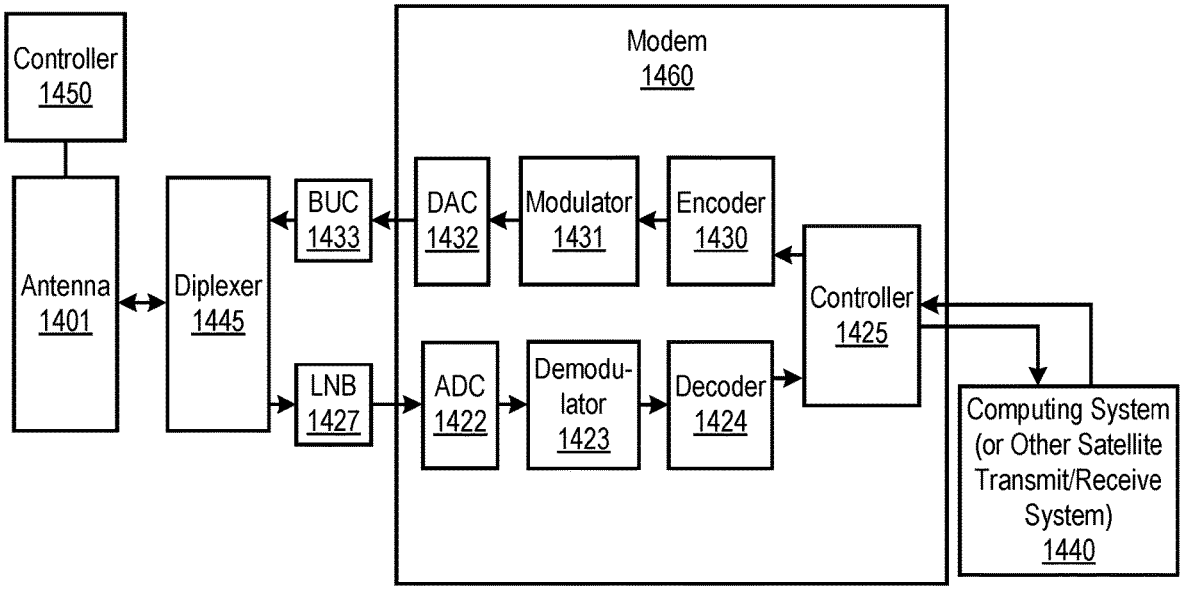
FIG. 14 is a block diagram of another embodiment of a communication system having simultaneous transmit and receive paths.

In another embodiment, the combined antenna apertures are used in a full duplex communication system. FIG. 14 is a block diagram of another embodiment of a communication system having simultaneous transmit and receive paths. While only one transmit path and one receive path are shown, the communication system may include more than one transmit path and/or more than one receive path.

Referring to FIG. 14, antenna 1401 includes two spatially interleaved antenna arrays operable independently to transmit and receive simultaneously at different frequencies as described above. In one embodiment, antenna 1401 is coupled to diplexer 1445. The coupling may be by one or more feeding networks. In one embodiment, in the case of a radial feed antenna, diplexer 1445 combines the two signals and the connection between antenna 1401 and diplexer 1445 is a single broad-band feeding network that can carry both frequencies.

Diplexer 1445 is coupled to a low noise block down converter (LNBs) 1427, which performs a noise filtering function and a down conversion and amplification function in a manner well-known in the art. In one embodiment, LNB 1427 is in an out-door unit (ODU). In another embodiment, LNB 1427 is integrated into the antenna apparatus. LNB 1427 is coupled to a modem 1460, which is coupled to computing system 1440 (e.g., a computer system, modem, etc.).

Modem 1460 includes an analog-to-digital converter (ADC) 1422, which is coupled to LNB 1427, to convert the received signal output from diplexer 1445 into digital format. Once converted to digital format, the signal is demodulated by demodulator 1423 and decoded by decoder 1424 to obtain the encoded data on the received wave. The decoded data is then sent to controller 1425, which sends it to computing system 1440.

Modem 1460 also includes an encoder 1430 that encodes data to be transmitted from computing system 1440. The encoded data is modulated by modulator 1431 and then converted to analog by digital-to-analog converter (DAC) 1432. The analog signal is then filtered by a BUC (up-convert and high pass amplifier) 1433 and provided to one port of diplexer 1445. In one embodiment, BUC 1433 is in an out-door unit (ODU).

Diplexer 1445 operating in a manner well-known in the art provides the transmit signal to antenna 1401 for transmission.

Controller 1450 controls antenna 1401, including the two arrays of antenna elements on the single combined physical aperture.

The communication system would be modified to include the combiner/arbiter described above. In such a case, the combiner/arbiter after the modem but before the BUC and LNB.

Note that the full duplex communication system shown in FIG. 14 has a number of applications, including but not limited to, internet communication, vehicle communication (including software updating), etc.

Some portions of the detailed descriptions above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; etc.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

We claim:

1. An antenna comprising:

an antenna aperture having at least one array of antenna elements operable to radiate radio frequency (RF) energy, wherein the array of antenna elements comprises a plurality of slot radiators; and an integrated composite stack structure coupled to the antenna aperture, the integrated composite stack structure including a wide angle impedance matching network to provide impedance matching between the antenna aperture and free space, and the integrated composite stack structure to put dipole loading on antenna elements, wherein the wide angle impedance matching network comprises a plurality of dipole elements.

2. The antenna defined in claim 1 wherein the impedance matching network improves the radiation efficiency of the antenna.

3. The antenna defined in claim 1 wherein the dipole loading elements in the array increase antenna element radiation efficiency and shift their resonant frequency response down.

4. The antenna defined in claim 1 wherein the impedance matching network provides impedance matching for all scan angles included in a range from a broadside angle to a scan roll-off angle.

5. The antenna defined in claim 1 wherein the impedance matching network comprises a metasurface stacked structure having N metasurface layers separated from each other by at least one dielectric layer, each of the N metasurface layers comprising a plurality of dipole elements, where each dipole element of the plurality of dipole elements is aligned with respect to one antenna element of the plurality of antenna elements, wherein N is an integer.

6. The antenna defined in claim 5 wherein said each dipole element is rotated with respect to an axis of the one antenna element.

7. The antenna defined in claim 6 wherein the array of antenna elements comprises a plurality of receive slot radiators interleaved with a plurality of transmit slot radiators, and the plurality of dipole elements are above and aligned with slot radiators in one or both of the plurality of receive slot radiators and the plurality of transmit slot radiators.

8. The antenna defined in claim 7 wherein each of the plurality of dipole elements is aligned with polarization of its corresponding receive slot radiator.

9. The antenna defined in claim 8 wherein each of the plurality of dipole elements is perpendicular with respect to its corresponding receive slot radiator.

10. The antenna defined in claim 5 wherein N is 2 or 3.

11. The antenna defined in claim 5 wherein the dielectric layer of at least one of the N layer pairs comprises a foam layer.

12. The antenna defined in claim 5 wherein heights of dielectric layers of the N metasurface layers are selected based on a satellite band frequency at which receive slot radiators of the plurality of receive slot radiators operate.

13. The antenna defined in claim 1 wherein the impedance matching network comprises an impedance matching layer having a metallic pattern above the antenna aperture.

14. The antenna defined in claim 13 wherein the metallic pattern comprises a periodic pattern of elements sized to provide an impedance for impedance matching between the antenna aperture and free space.

15. The antenna defined in claim 14 wherein the periodic pattern of elements comprises split ring resonators.

16. The antenna defined in claim 13 wherein the metallic pattern comprises elements that react with a polarized electric field generated by the antenna aperture.

17. The antenna defined in claim 13 wherein the impedance matching network further comprises a dielectric layer between the antenna aperture and the impedance matching layer.

18. The antenna defined in claim 17 wherein the dielectric layer comprises a foam layer.

19. The antenna defined in claim 1 further comprising a plurality of dipole elements on top of the plurality of antenna elements.

20. The antenna defined in claim 19 wherein the plurality of dipole elements is part of a dipole patterned superstrate on top of the antenna aperture.

21. The antenna defined in claim 19 further comprising a metallic layer printed on a dielectric material and displaced a distance from the antenna aperture, the metallic layer including the plurality of dipole elements.

22. The antenna defined in claim 19 wherein each of the plurality of dipole elements is operable to load a unit cell of one of the plurality of antenna elements.

23. The antenna defined in claim 19 wherein each of the plurality of dipole elements is operable to shift a frequency band of operation of a unit cell of one or more of the plurality of antenna elements.

24. The antenna defined in claim 1 wherein the impedance matching layer comprises tunable radiating elements.

25. The antenna defined in claim 24 wherein the tunable radiating elements comprise ring-shaped dipoles.

26. The antenna defined in claim 1 wherein the antenna aperture is a cylindrically fed holographic radial antenna aperture.

27. The antenna defined in claim 1 wherein each of the at least one array of antenna elements is controlled to generate a beam using holographic beam forming.

28. An antenna comprising:

an antenna aperture having at least one array of antenna elements operable to radiate radio frequency (RF) energy; and an integrated composite stack structure coupled to the antenna aperture, the integrated composite stack structure including a wide angle impedance matching network to provide impedance matching between the antenna aperture and free space, and wherein the integrated composite stack structure is to put dipole loading on antenna elements, and further wherein the impedance matching network provides impedance matching for all scan angles included in a range from a broadside angle to a scan roll-off angle, wherein the impedance matching network comprising a metasurface stacked structure having N metasurface layers separated from each other by at least one dielectric layer, each of the N metasurface layers comprising a plurality of dipole elements, where each dipole element of the plurality of dipole elements is over and aligned with respect to one antenna element of the plurality of antenna elements, wherein N is an integer.

29. The antenna defined in claim 28 wherein the array of antenna elements comprises a plurality of receive slot radiators interleaved with a plurality of transmit slot radiators, and the plurality of dipole elements are above and aligned with slot radiators in one or both of the plurality of receive slot radiators and the plurality of transmit slot radiators.

30. The antenna defined in claim 29 wherein each of the plurality of dipole elements is aligned with polarization of its corresponding receive slot radiator.

31. An antenna comprising:

an antenna aperture having at least one array of antenna elements operable to radiate radio frequency (RF) energy; and an integrated composite stack structure coupled to the antenna aperture, the integrated composite stack structure including a wide angle impedance matching network to provide impedance matching between the antenna aperture and free space, and wherein the integrated composite stack structure is to put dipole loading on unit cells of antenna elements using a plurality of dipole elements on top of the plurality of antenna elements, wherein each of the plurality of dipole elements is operable to shift a frequency band of operation of a unit cell of one or more of the plurality of antenna elements, and further wherein the impedance matching network provides impedance matching for all scan angles included in a range from a broadside angle to a scan roll-off angle.

32. The antenna defined in claim 31 wherein the plurality of dipole elements is part of a dipole patterned superstrate on top of the antenna aperture.

33. The antenna defined in claim 31 further comprising a metallic layer printed on a dielectric material and displaced a distance from the antenna aperture, the metallic layer including the plurality of dipole elements, and wherein each of the plurality of dipole elements is operable to load a unit cell of one of the plurality of antenna elements.

* * * * *